US006186363B1

(12) United States Patent
Keller et al.

(10) Patent No.: US 6,186,363 B1
(45) Date of Patent: Feb. 13, 2001

(54) BAYONET FASTENING DEVICE FOR THE ATTACHMENT OF AN ACCESSORY TO A MULTIPLE COMPONENT CARTRIDGE OR DISPENSING DEVICE

(75) Inventors: Wilhelm A. Keller, Obstgartenweg 9, CH-6402 Merlischachen (CH); Richard J. Wilson, Andover, MA (US)

(73) Assignee: Wilhelm A. Keller, Merlischachen (CH)

( * ) Notice: Under 35 U.S.C. 154(b), the term of this patent shall be extended for 0 days.

(21) Appl. No.: 09/348,038

(22) Filed: Jul. 6, 1999

Related U.S. Application Data

(63) Continuation of application No. 08/563,109, filed on Nov. 27, 1995, now Pat. No. 5,918,772, which is a continuation-in-part of application No. 08/403,172, filed on Mar. 13, 1995, now abandoned, and a continuation-in-part of application No. 08/522,109, filed on Aug. 31, 1995, now abandoned.

(30) Foreign Application Priority Data

Aug. 24, 1995 (EP) ..... 95810531

(51) Int. Cl.[7] ..... B67D 5/56

(52) U.S. Cl. ..... 222/145.6; 222/145.5; 222/137

(58) Field of Search ..... 222/145.5, 145.6, 222/567, 326, 327, 136, 137; 285/360, 361, 376, 401, 396, 400, 402, 915

(56) References Cited

U.S. PATENT DOCUMENTS

| | | | |
|---|---|---|---|
| 2,816,518 | 12/1957 | Daggett . | |
| 3,143,255 | 8/1964 | Leeds . | |
| 3,323,682 | 6/1967 | Creighton et al. . | |
| 3,884,388 | 5/1975 | Holcomb . | |
| 4,014,463 | 3/1977 | Hermann . | |
| 4,117,551 | 9/1978 | Books et al. . | |
| 4,240,566 | 12/1980 | Bergman . | |
| 4,432,469 | 2/1984 | Eble et al. . | |
| 4,471,888 | 9/1984 | Herb et al. . | |
| 4,538,920 | 9/1985 | Drake | 222/145.6 |
| 4,566,610 | 1/1986 | Herb . | |
| 4,687,663 | 8/1987 | Schaeffer . | |
| 4,690,306 | 9/1987 | Staeheli . | |
| 4,747,517 | 5/1988 | Hart . | |
| 4,753,536 | 6/1988 | Spehar et al. . | |
| 4,767,026 | 8/1988 | Keller et al. | 222/145.6 |
| 4,771,919 | 9/1988 | Ernst . | |
| 4,846,373 | 7/1989 | Penn et al. . | |
| 4,869,400 | 9/1989 | Jacobs . | |
| 4,871,090 | 10/1989 | Hoffman . | |
| 4,913,553 | 4/1990 | Falco . | |
| 4,946,079 | 8/1990 | Campbell . | |
| 4,974,756 | 12/1990 | Pearson et al. . | |
| 4,978,336 | 12/1990 | Capozzi et al. . | |
| 4,981,241 | 1/1991 | Keller . | |
| 4,989,758 | 2/1991 | Keller | 222/145.6 |

(List continued on next page.)

FOREIGN PATENT DOCUMENTS

| | | | |
|---|---|---|---|
| 0 730 913 | * | 11/1996 | (EP) . |
| 2232910 | | 1/1991 | (GB) . |

* cited by examiner

*Primary Examiner*—Kenneth Bomberg
(74) *Attorney, Agent, or Firm*—Foley & Lardner

(57) ABSTRACT

A bayonet attachment on a cartridge for attaching a mixer or accessory to a multiple component cartridge is formed as a ring-shaped bayonet socket with two internal recesses and two diametrically opposed cutouts forming one bayonet coupling part, whereas the bayonet attachment of the mixer or accessory comprises two bayonet lugs corresponding to the cutouts. In a preferred embodiment, the respective inlets of the mixer housing or the outlets of the cartridge have different sizes or shapes to provide coded alignment between the cartridge and the mixer.

7 Claims, 30 Drawing Sheets

U.S. PATENT DOCUMENTS

| | | | |
|---|---|---|---|
| 4,995,540 | 2/1991 | Colin et al. . | |
| 5,020,694 | 6/1991 | Pettengill . | |
| 5,022,563 | 6/1991 | Marchitto et al. . | |
| 5,033,650 | 7/1991 | Colin et al. . | |
| 5,038,963 | 8/1991 | Pettengill et al. . | |
| 5,065,906 | 11/1991 | Maeder . | |
| 5,080,262 | 1/1992 | Herold et al. . | |
| 5,137,182 | 8/1992 | Keller | 222/145.6 |
| 5,228,599 | 7/1993 | Keller . | |
| 5,249,709 | 10/1993 | Duckworth et al. . | |
| 5,249,862 | 10/1993 | Herold et al. . | |
| 5,289,949 | 3/1994 | Gentile . | |
| 5,333,760 | 8/1994 | Simmen | 222/145.6 |
| 5,413,253 | 5/1995 | Simmen | 222/145.6 |
| 5,609,271 * | 3/1997 | Keller et al. | 222/145.6 |
| 5,918,772 * | 7/1999 | Keller et al. | 222/145.6 |

BAYONET FASTENING DEVICE FOR THE ATTACHMENT OF AN ACCESSORY TO A MULTIPLE COMPONENT CARTRIDGE OR DISPENSING DEVICE

CROSS-REFERENCE TO RELATED APPLICATIONS

The present application is a continuation of patent application Ser. No. 08/563,109, filed Nov. 27, 1995, now U.S. Pat. No. 5,918,772, which is a continuation in part of patent application Ser. No. 08/403,172 filed Mar. 13, 1995, now abandoned, and a continuation in part of patent application Ser. No. 08/522,109 filed Aug. 31, 1995 now abandoned.

BACKGROUND OF THE INVENTION

The present invention relates to a bayonet fastening device for the attachment of an accessory to a dispensing device, in particular for the attachment of a mixer to a two-component cartridge.

There exists a great number of mixers and cartridges having means for attaching the mixer to the cartridge for example, U.S. Pat. Nos. 4,767,026 and 4,538,920 disclose on mixer that has two bayonet locking lugs inserted into corresponding prongs on the cartridge by rotation. On one hand, the rotary locking movement of the complete mixer will cause contamination of one chemical component against the other chemical component at the interface between the cartridge and the mixer, in that these components will be transported from one outlet to the other outlet, from one inlet to the other inlet, causing an undesired reaction between these chemical components at the interface between cartridge and mixer or closure means, and eventually carrying such a reaction back into the cartridge outlets, thus causing plugging of the outlets. On the other hand there exist situations where it is necessary to connect and attach the mixer or accessory to a multiple component cartridge or dispensing device in a predetermined position, such as when cartridge outlets or mixer inlets are of a different size for different relative mixing ratios or when mixers or accessories are refitted for reuse.

There exists a need to connect and attach a mixer or accessory to a multiple component cartridge or dispensing device in a predetermined orientation, such as when cartridge outlets or mixer inlets are of a different size for different relative mixing ratios or when special high ratio mixers are used for greater mixing efficiency and when mixers or accessories are refitted for reuse. In the latter case of reuse, it is necessary to avoid any possibility of cross contamination of one chemical component against another during refitting. Such cross contamination of reactive chemical systems can cause plugging at the cartridge outlets and cause a reaction back into and within the cartridge.

U.S. Pat. No. 5,228,599 discloses a multiple dispensing cartridge having a mixer attached thereto with the aid of a coupling nut having an internal thread, wherein each storage cylinder ends in a dispensing opening which forms a side by side outlet, whereas the inlet of the mixer is not defined. The mixer is put on the cartridge and secured by a coupling nut via an external thread at the cartridge.

Another cross contamination situation can occur when a clean mixer or accessory inlet area or closure plugs are able to make any form of incorrect alignment contact, such as by angular tipping, with the chemical components at the cartridge outlet area during the process of initial placing of the mixer or closure plugs against the cartridge in preparation for attachment. In that case, when fitting the same mixer or closure plugs in the correct position, it is possible to now chemically contaminate the outlets of the cartridge. Again, this can cause plugging and a reaction back into and within the cartridge.

Additionally, it is commonly found in bayonet attachment means of the prior art that the bayonet prongs of the cartridge are relatively small and therefore of limited structural rigidity and strength. This allows the possibility of distortion and is of greater significance due to the trend towards smaller mixer diameters and therefore high backpressures, the result being leakage at the mixer to cartridge sealing interface during dispensing.

SUMMARY OF THE INVENTION

On the basis of this prior art, it is an object of the present invention to provide for a bayonet attachment device for attaching a mixer, or closure means or any other accessory, such as an adapter or a connecting tube to a multiple component dispensing device, in particular a two component cartridge, which has improved strength and structural rigidity against stress caused by greater hydraulic forces due to the trend towards smaller mixer diameters as well as providing improved interface sealing.

This object is attained with a device wherein said bayonet attachment means at the dispensing apparatus or cartridge is formed as ring-shaped bayonet socket, with at least two internal recesses or an inner circular groove with at least two bayonet cutout followed by adjacent bayonet retaining means, and wherein the bayonet attachment means of the accessory comprises at least two bayonet lugs corresponding to the cut outs.

It is another object of the invention that alignment of the accessory inlets to the cartridge outlets takes place in one position only to avoid cross contamination. This object is attained with a device wherein said bayonet attachment means at the dispensing apparatus or cartridge and at the accessory have means for coded alignment of the accessory to the dispensing apparatus or cartridge.

Other objects and improvements of the device are defined in the dependent claims.

BRIEF DESCRIPTION OF THE DRAWINGS

The invention will be explained in more detail hereinafter with reference to a drawing of embodiments.

FIGS. 1–6 show a first embodiment of the invention with a rotatable mixer housing, wherein FIG. 1 is a longitudinal section of a mixer, FIG. 2 is a view of the inlet end of the mixer, FIG. 3 is a longitudinal section of a cartridge, FIG. 4 is a top view of the cartridge of FIG. 3 with distanced outlets and ring-shaped bayonet means, FIG. 5 is a longitudinal section of a cartridge having two containers with different cross-sectional areas, FIG. 6 is a top view of the cartridge of FIG. 5 with distanced outlets and ring-shaped bayonet means.

FIGS. 7–13 show a second embodiment of the invention comprising a coupling ring, wherein FIG. 7 is a longitudinal section of a mixer, FIG. 8 is a view of the inlet end of the mixer, FIG. 9 is a longitudinal section of a cartridge with distanced outlets and ring-shaped bayonet means, FIG. 10 is a top view of the cartridge of FIG. 9 with a nose piece, FIG. 11 is a top view of a coupling ring, FIG. 12 is a section of the coupling ring of FIG. 11, FIG. 13 is a longitudinal section of a variant of the mixer of FIG. 7 and 8 attached to the cartridge of FIGS. 5 and 6 having containers with different cross-sectional area.

FIGS. 14–19 show a third embodiment of the invention with a locking ring permanently attached to the cartridge, wherein FIG. 14 is a longitudinal section of a cartridge with distanced outlets, FIG. 15 is a top view of the cartridge of FIG. 14, FIG. 17 is a section of the locking ring according to the line XVII—XVII of FIG. 16B, FIGS. 18 and 19 show in two longitudinal sections at 90° to each other a mixer attached to the cartridge of FIG. 14 with the locking ring of FIGS. 16A–17, in the locked position.

FIGS. 20–25 show three embodiments of a closure cap for the cartridge, wherein FIGS. 20–21 show as first embodiment a two part closure cap in a longitudinal section and a view on its cartridge side face, FIGS. 22–23 show as second embodiment a one part closure cap for use with a coupling ring in a longitudinal section and a view on its cartridge side face.

FIGS. 24–25 show as third embodiment a one part closure cap for use with a locking ring attached to the cartridge in a longitudinal section and a view on its cartridge side face.

FIGS. 26–28 show an alternative embodiment of the invention with a ring-shaped bayonet socket at the rotatable mixer housing, wherein FIG. 26 is a longitudinal section of a mixer attached to a partially shown cartridge, FIG. 27 is a view of the inlet end of the mixer, and FIG. 28 is a top view of the cartridge of FIG. 26.

FIGS. 29–31 show a further embodiment of the invention with a ring-shaped bayonet socket at the cartridge, wherein FIG. 29 is a longitudinal section of a mixer attached to a partially shown cartridge, FIG. 30 is a view of the inlet end of the mixer, and FIG. 31 is a top view of the cartridge of FIG. 29.

FIGS. 32–34 show a further embodiment of the invention with a ring-shaped bayonet socket at the cartridge, wherein FIG. 32 is a longitudinal section of a mixer attached to a partially shown cartridge, FIG. 33 is a view of the inlet end of the mixer, and FIG. 34 is a top view of the cartridge of FIG. 32.

FIGS. 35–37 show an further embodiment of the invention with a sector-shaped bayonet socket at the cartridge, wherein FIG. 35 is a longitudinal section of a mixer attached to a partially shown cartridge, FIG. 36 is a top view of the cartridge of FIG. 35, and FIG. 37 is a view of the inlet end of the mixer.

FIGS. 38–40 show an alternative embodiment of the invention with a sector-shaped bayonet socket at the cartridge, wherein FIG. 38 is a longitudinal section of a mixer attached to a partially shown cartridge, FIG. 39 is a top view of the cartridge of FIG. 38, and FIG. 40 is a view of the inlet end of the mixer.

FIGS. 41–44 show a further embodiment of the invention with a coupling ring, wherein FIG. 41 is a longitudinal section of a mixer, FIG. 42 is a longitudinal section of a coupling ring, FIG. 43 is a top view of the coupling ring of FIG. 42, and FIG. 44 is a longitudinal section of the mixer attached to a partially shown cartridge via the coupling ring.

FIGS. 45–47 show a further embodiment of the invention with a sector-shaped bayonet socket at the mixer, wherein FIG. 45 is a longitudinal section of a mixer attached to a partially shown cartridge, FIG. 46 is a top view of the cartridge of FIG. 41, and FIG. 47 is a view of the inlet end of the mixer.

FIGS. 48–58 show several further coding means at both the cartridge and the mixer for preventing cross-contamination by erroneous attachment of the mixer onto the cartridge, wherein FIG. 48 is a top view of a cartridge like in FIG. 39, with additional coding means, FIG. 49 is a section of the inlet end of a mixer like in FIG. 38, with additional coding means, FIG. 50 is a view of the inlet end of the mixer of FIG. 49.

FIGS. 51 and 52 show a variant of the coding means at the cartridge and mixer.

FIGS. 53 and 54 show a further variant of the coding means at the cartridge and mixer.

FIGS. 55 and 56 show a further variant of the coding means at the cartridge and mixer.

FIGS. 57 and 58 show a further variant of the coding means at the cartridge and mixer.

DETAILED DESCRIPTION OF THE PREFERRED EMBODIMENTS

Figure 1:
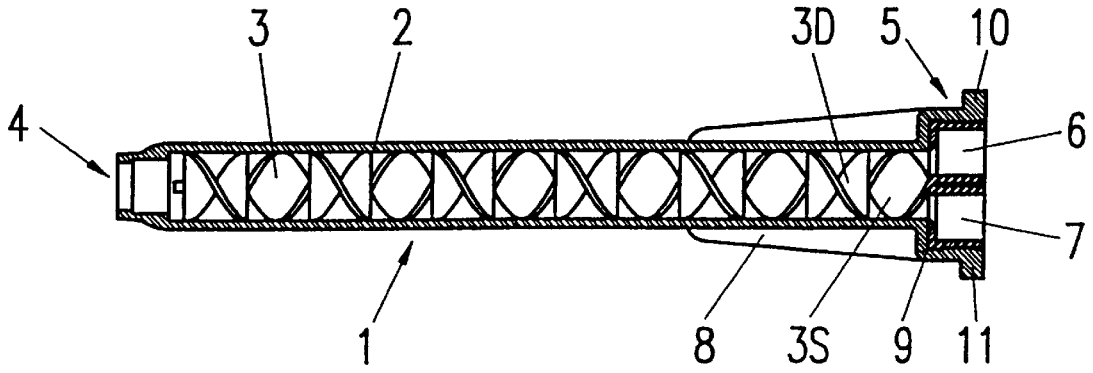
Figure 2:
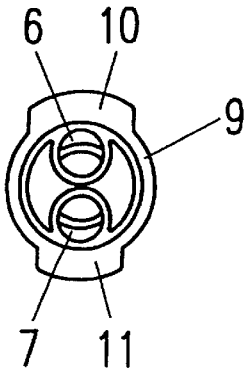

FIGS. 1–2 show a mixer 1 comprising a mixer housing 2, a mixer element group 3, the mixer outlet 4 and a mixer inlet section 5 with two separated inlet parts 6 and 7, which are integral with a properly aligned separating element 3S of the mixer element group 3. This mixer is attached to the cartridge by matching the mixer different width bayonet lugs 10, 11 to the different width bayonet sockets 19, 20 while pressing the mixer onto the cartridge and by rotating the mixer housing 2. The separated inlet parts 6 and 7 and the mixer element group 3 with the separating element 3S do not rotate. Separating element 3S serving in this embodiment as a separating means for guiding each chemical component separately to the first dividing element 3D of the mixer element group 3.

The mixer housing is provided with longitudinal ribs 8 that end at the larger diameter 9 of the mixer housing 2. The two lateral ends of the ribs are formed as bayonet lugs 10 and 11 cooperating with the bayonet retaining means of the cartridge. As follows from FIG. 2, the two lugs do not have the same width, lug 10 being larger than lug 11. As will be shown later, the different width of the lugs enable a coded alignment and attachment of the mixer to the cartridge.

The mixer element group 3 is connected to the separated inlet parts 6 and 7 and is disposed in such a way within the housing that the housing itself is rotatable around the mixer element group 3 with attached inlet parts 6 and 7, which are arranged at the inlet side of the first mixer element 3S serving in this embodiment as a separating means for guiding each component separately to the first dividing element 3D of the mixer element group 3.

Figure 3:
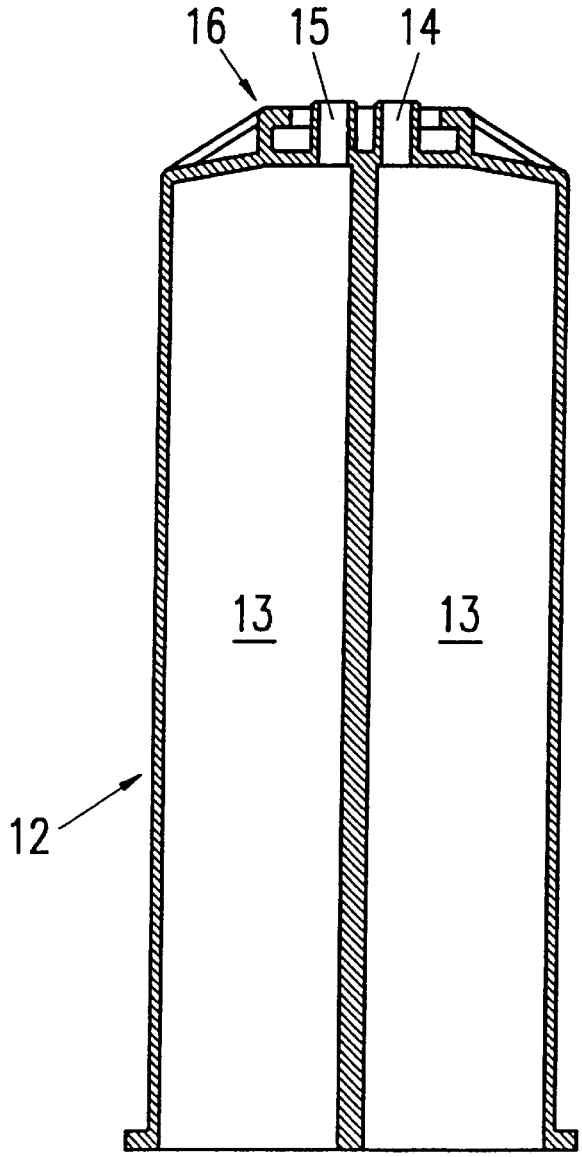

In FIG. 3, the cartridge 12 comprises two cylindrical containers or chamber 13 of equal cross-sectional areas for a 1:1 metering ratio ending in two individual, separate cylindrical and distal outlets 14 and 15. The outside shapes of the distal outlets 14 and 15 of the cartridge correspond to the respective inside shapes of the separate inlets 6 and 7 of the mixer, (see FIG. 1) whereby the inlets of the mixer fit over the outlets of the cartridge for tightly sealed connections. A reverse arrangement, where the inlet parts 6 and 7 fit into the outlet openings 14 and 15 is also possible.

Figure 4:
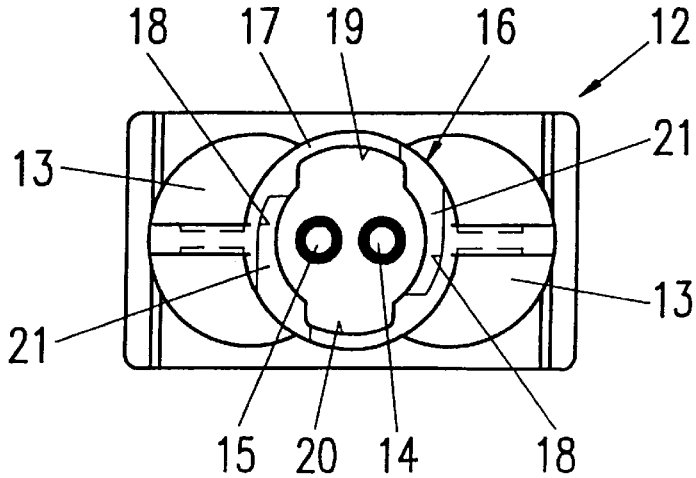

In FIG. 4, the bayonet means 16 at the cartridge comprises a ring-shaped bayonet socket 17 with two internal recesses 18 and a circular opening with two diametrically opposed different width bayonet cutouts 19 and 20 for receiving the corresponding different width bayonet lugs 10 and 11, (see FIG. 1), of the mixer, allowing coded introduction of the mixer in one predetermined position only. The flange parts 21 adjacent to the cutouts serve as bayonet retaining means for securing the lugs of the mixer.

The ring-shaped bayonet means provides, in particular, for increased strength of the bayonet retaining means and increased structural rigidity of the outlet end of the cartridge when, during dispensing, the hydraulic forces transmitted from the attached mixer are at a maximum. This arrangement is a substantial improvement in comparison with the prior art bayonet prongs.

Figure 5:
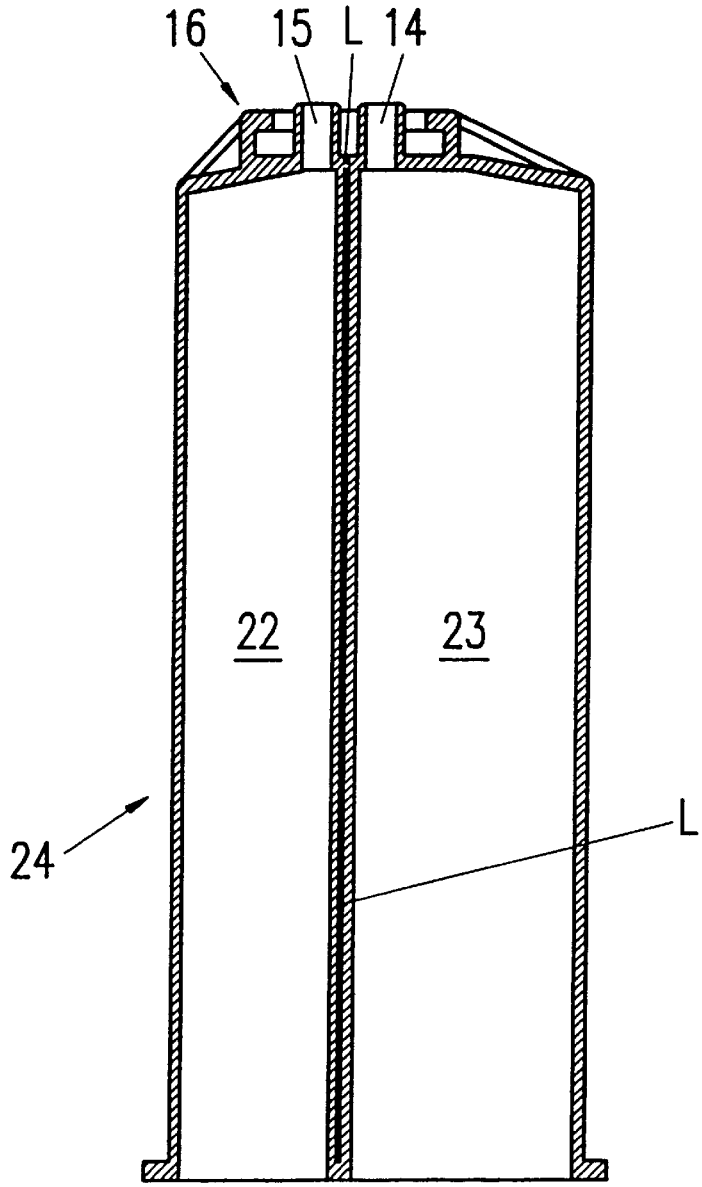
Figure 6:
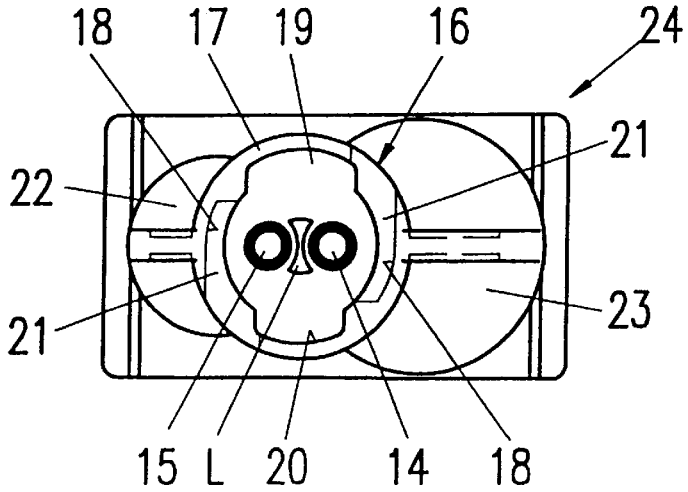

FIGS. 5 and 6 show a variant to the embodiment shown in FIGS. 1–4 in that the containers 22 and 23 of cartridge 24 have different cross-sectional areas for metering ratios other than 1:1.

In both described cases, in order to attach the mixer to the cartridge, the mixer can only be aligned with its bayonet lug widths corresponding to the different width cut outs of the bayonet sockets, then pressed onto the cartridge such that when the mixer is in place and the outlets and inlets are connected, the mixer housing 2 is rotated by 90° for the engagement of the bayonet lugs 10, 11 in the bayonet retaining means 21 of the cartridge. This attachment method prevents contamination of one component by the other at the mixer-cartridge interface yet enabling a quick coded attachment of the mixer.

Figure 7:
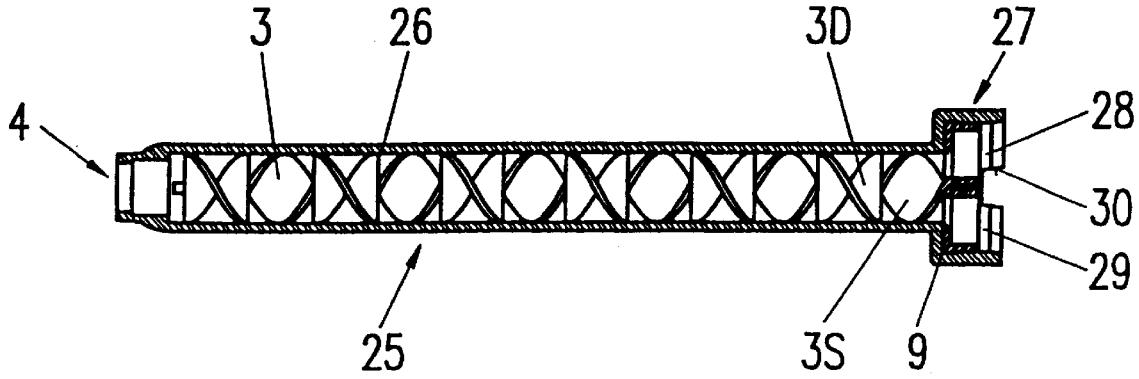
Figure 8:
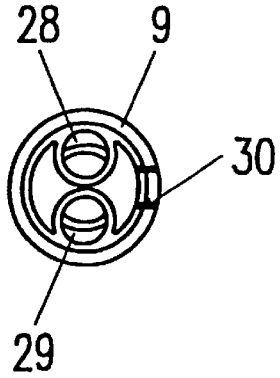
Figure 11:
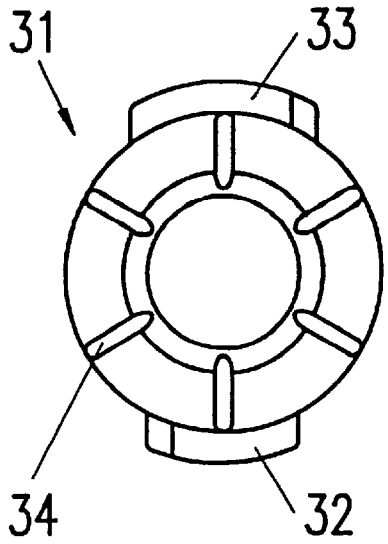
Figure 12:
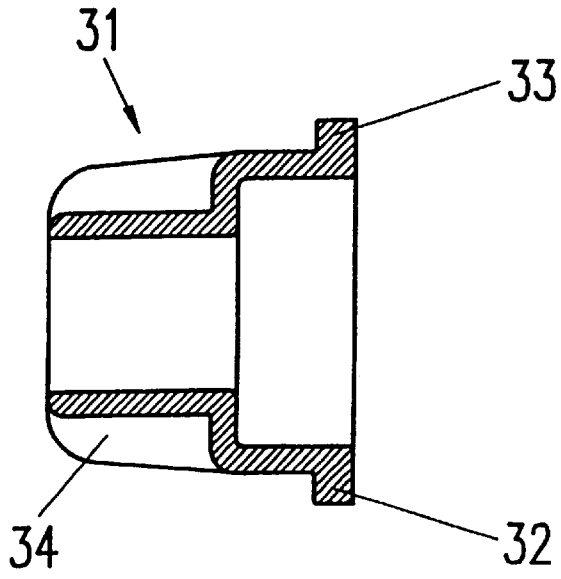

FIGS. 7 and 8 show in a second embodiment a mixer 25 comprising a mixer housing 26, a mixer element group 3, a mixer outlet 4, and a mixer inlet section 27. This mixer is fixed to the cartridge 35 (see FIG. 9) with the aid of a separate coupling ring (see FIGS. 11 and 12). The coupling ring 31 is provided with two bayonet lugs 32 and 33 corresponding to the bayonet cutouts 19, 20, respectively of the bayonet attachment means 16 at the cartridge. For better manual gripping, ribs 34 are provided on the outer cylindrical surface.

It follows in particular from FIG. 7 that the mixer inlet section 27 comprises two cylindrical, individual inlet openings 28, 29 at the inlet side face of the first mixer element 3S serving in this embodiment as a separating means for guiding each component separately to the first dividing element 3D of the mixer element group 3. A slot 30 provides for a coded alignment of the mixer in regard to a cartridge.

Cartridge 35 (see FIGS. 9 and 10) is the same as cartridge 1 of FIG. 1 with the exception that the bottom of the bayonet attachment means 16 comprises a nose piece 36 corresponding to the slot 30 at the mixer (see FIGS. 7 and 8), for coded alignment of the mixer.

When connecting the mixer to the cartridge, the nose piece 36 on the cartridge fits into slot 30 of the mixer inlet section 27. This coded connection method assures not only one alignment possibility but also axial mixer attachment without rotation of the mixer housing, thus preventing contamination of one component by the other at the cartridge/mixer interface.

There are other coding means possible at the dispensing apparatus or cartridge and at the accessory for the coded alignment of the accessory to the dispensing apparatus or cartridge, e.g. pins or protruding parts of all kind fitting into a recess or cavity or slot. The coding means may also take the form of differently shaped, similar or dissimilar sized inlets and outlets as described later in the specification.

Figure 13:
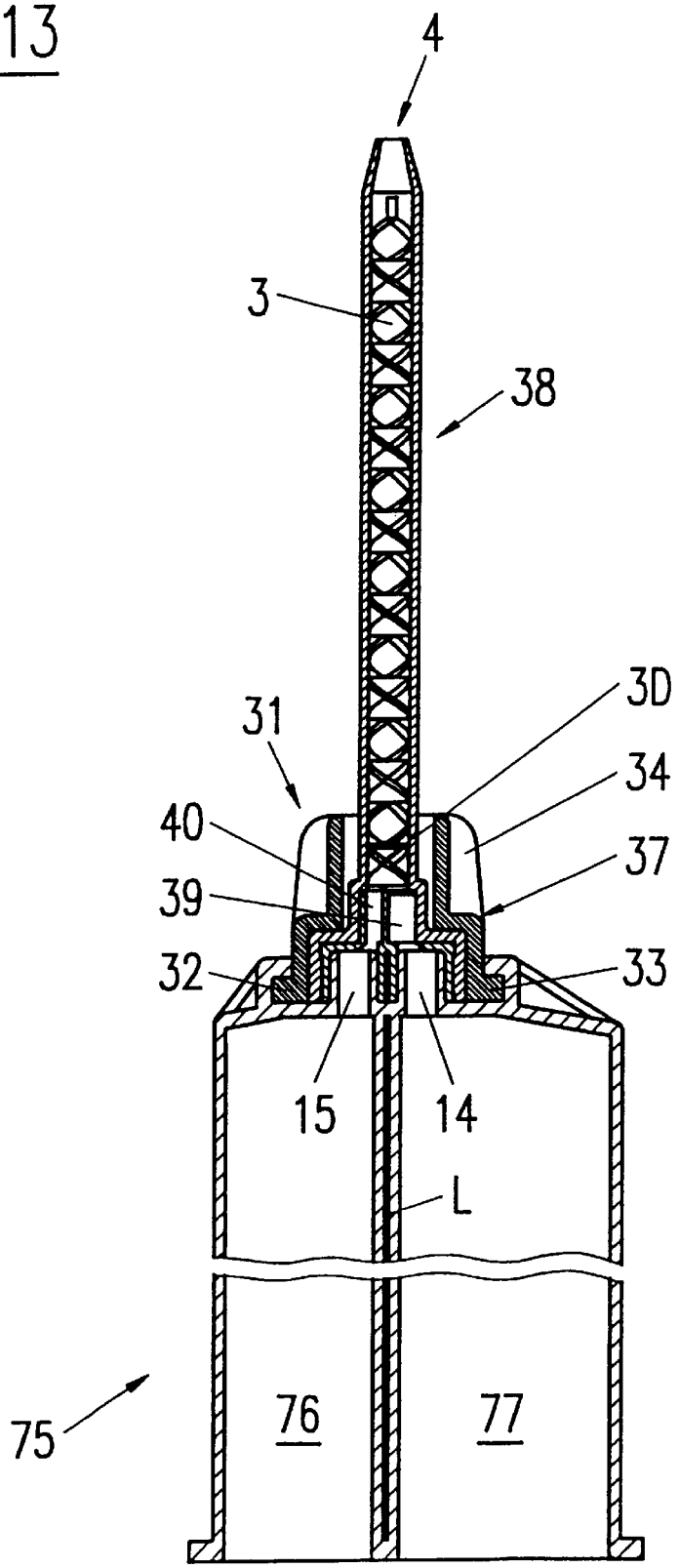

FIG. 13 shows a mixer 38 attached to a cartridge 75 having containers 76 and 77 with different cross-sectional areas, as a variant to the embodiment shown in FIGS. 5–12 in that the mixer inlet section 37 of mixer 38 has a separating means within the mixer, which separating means comprises separated inlet chambers 39, 40, respectively having different cross-sectional areas, and lodged within a smaller combined diameter than the cartridge outlet with corresponding openings for each chamber for material to pass through.

The aforementioned separating means serves to maintain separation of the material flows up to the first dividing element 3D of the mixer element group 3. This separating means can have chambers with equal cross-sectional areas or have a cross-sectional area ratio other than 1:1. For example, the ratio of the cross-sectional areas of the separating chambers can be adapted to the cross-sectional areas of the containers 76 and 77 of cartridge 75, respectively to its metering ratio. The separating means is fixedly connected to the mixer element group 3.

The cartridge 75 has the same attaching means as in FIGS. 5 and 6, and the mixer 38 is attached to the cartridge by means of the coupling ring 31.

The third embodiment of the invention according to the FIGS. 14–19 comprises a locking ring 51 that is snapped onto and permanently attached to the cartridge 42. The cartridge 42 comprises two cylindrical containers or chambers 43 of equal cross-sectional area, two distal outlets 45 and 46, and an attaching means 47 for attaching the locking ring 51 and for limiting its rotational movement. The form of the attaching means 47 is a circular edge 49 with two lugs 44 of same width and arranged around the two distal outlets with a circular undercut 48 at its base.

The locking ring 51 (see FIGS. 16A and 16B) and 17, snaps over circular edge 49 of the attaching means of the cartridge and remains attached to it. The locking ring 51 has an inner circular groove 52 forming a cartridge side edge 53 and a mixer side edge 54. The cartridge side edge 53 has two opposed cutouts 55 the width of which corresponds to the lugs 44 of the attaching, means whereby the inner diameter of the cartridge side edge 53 is slightly smaller than the outer diameter of the circular edge 49 of the attaching means of the cartridge. For snapping the locking ring to the cartridge, the ring is positioned so that the cutouts of its cartridge side edge are placed above the lugs of the attaching means and the ring is then pushed onto the cartridge so that the remaining cartridge side edge of the locking ring slides into the circular undercut 48 of the attaching means. The locking ring is also provided with a serration 58 for better manual gripping.

The mixer side edge 54 has two opposite cutouts 56 and 57 of different width corresponding to the lugs 10 and 11 of the mixer for insertion in one position only. These two cutouts are arranged at 90° to the cutouts 55 of the cartridge side edge. Thus, when the mixer 59 is to be attached to the locking ring on the cartridge and the locking ring is rotated by 90°, the remaining inside flange parts of both the cartridge side edge and the mixer side edge serve as bayonet retaining means to encompass the mixer lugs 10 and 11 as well as the lugs 44 of the attaching means 47 of the cartridge for strong securement.

Figure 14:
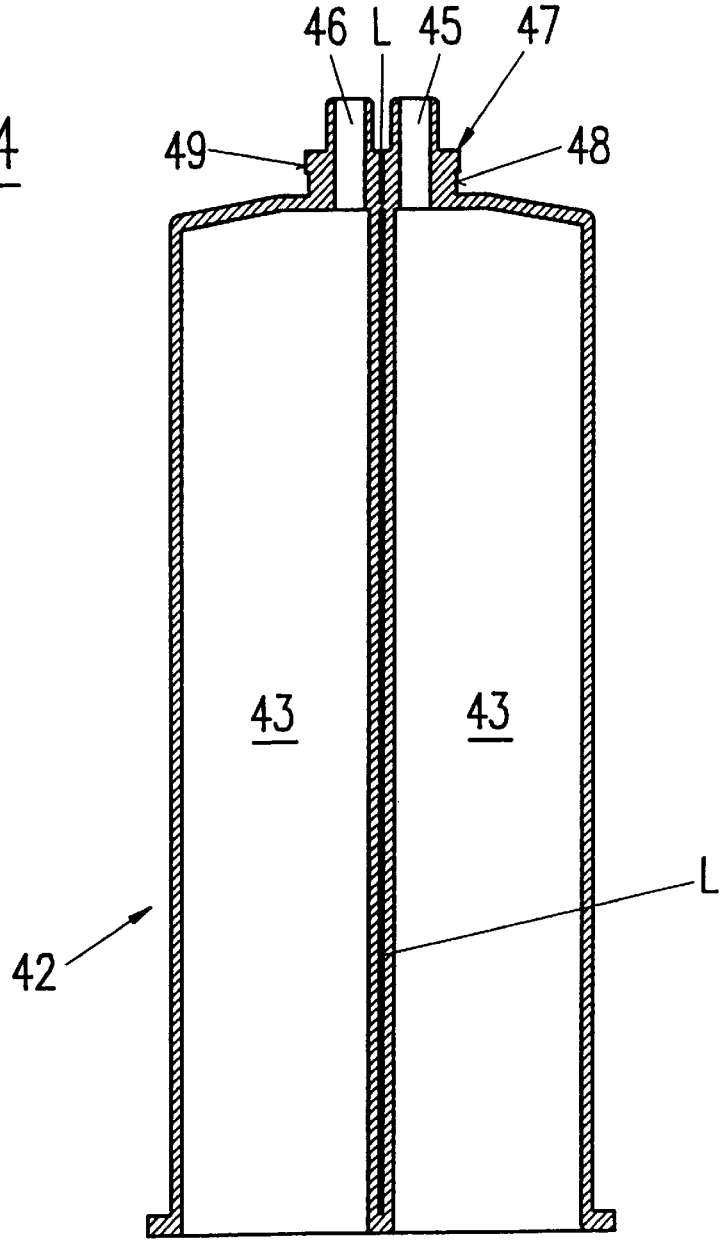
Figure 15:
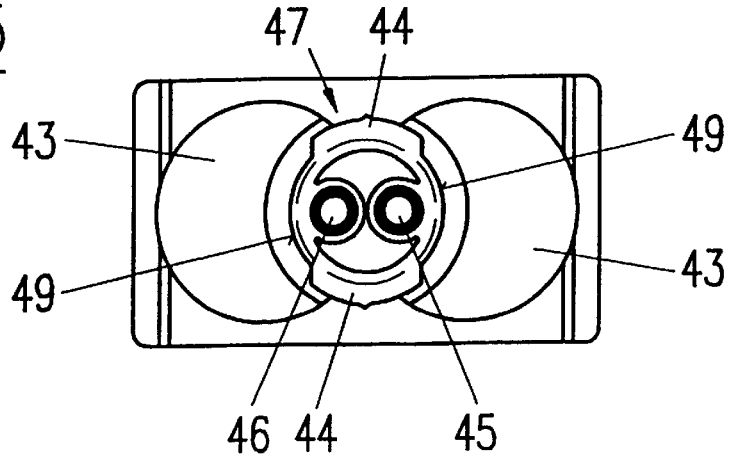
Figure 16A:
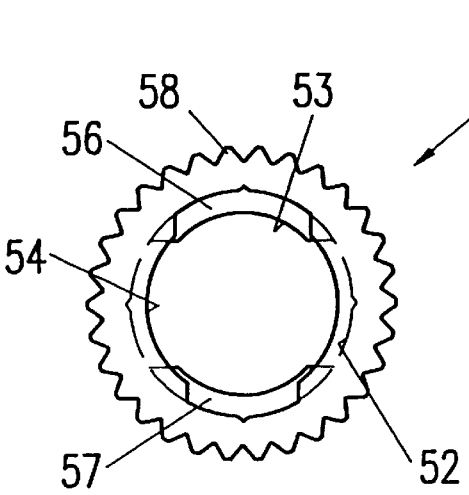
FIG. 16A is a view on the mixer side of a locking ring to be attached to the cartridge.
Figure 16B:
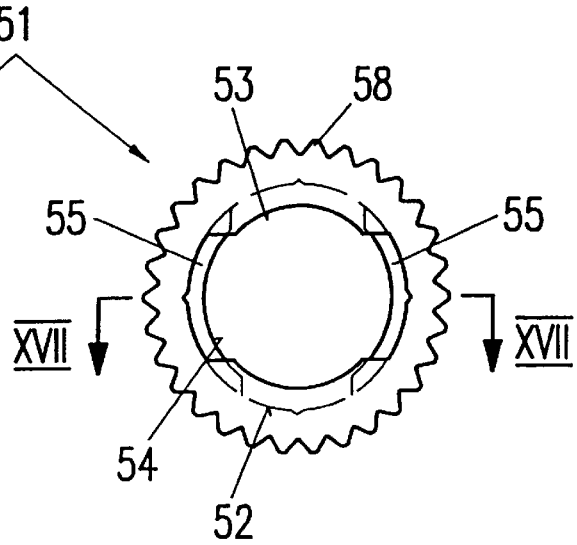
FIG. 16B is a view on the cartridge side of the locking ring of FIG. 16A.
Figure 17:
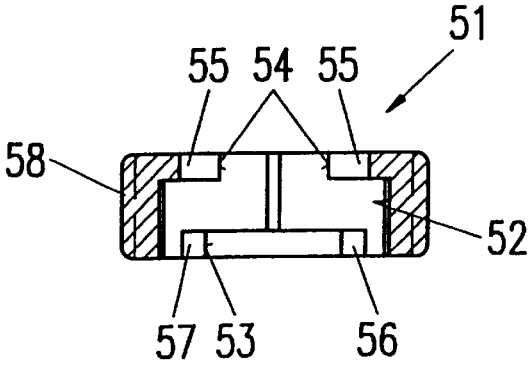
Figure 18:
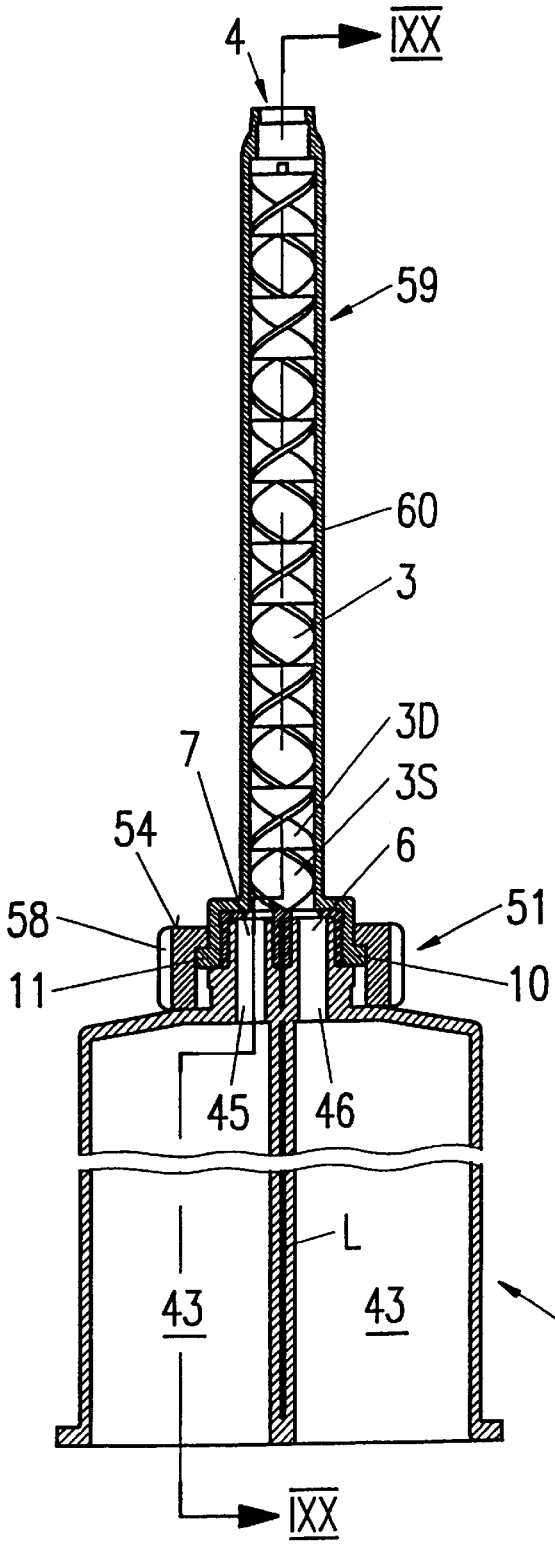
Figure 19:
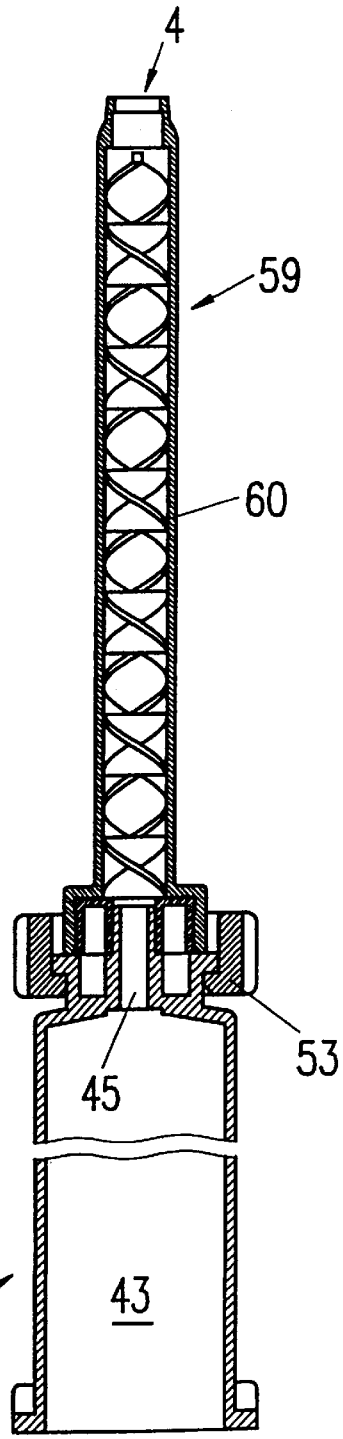

FIGS. 18 and 19 show cartridge 42 of FIG. 14 with a mixer 59, which is similar to mixer 1 of FIG. 1 with the same mixer inlet section 5 with separate female inlets 6 and 7, except that the housing 60 is not rotatable around the integral internal parts of the mixer and has no ribs 8, and the two bayonet lugs 10 and 11 are of different widths. FIG. 18 shows the mixer introduced within the locking ring 51 with the locking ring in its locked position and FIG. 19 shows a section along the line XIX—XIX in FIG. 18 of the same assembly at 90°. It is evident that a mixer with separated inlet chambers can be attached likewise and also that a cartridge may be one having containers with different cross-sectional areas as in FIG. 5.

The above described system of the coded attachment of the mixer also allows for the coded attachment of closure caps, adapters etc:., thus preventing cross contamination and allowing closure cap re-use.

Figure 20:
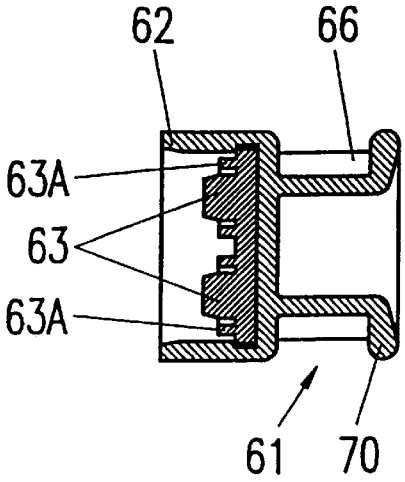
Figure 21:
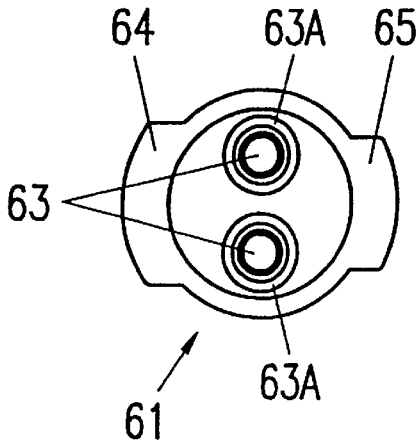

The first embodiment of a coded closure cap 61, FIGS. 20 and 21, consists of two parts. The insert 62 has two male plugs 63 for closing the outlets of a cartridge, for example the distanced outlets 14 and 15 of cartridge 12 of FIG. 3.

In this embodiment it is shown how the sealing effect of a plug at the cartridge outlet can be improved by providing the male plug 63 with a second rim 63A reaching over the female cartridge outlet. The provision of such a male plug with a circumferential rim is of course not limited to this example.

The rotatable attaching means has two bayonet lugs 64 and 65 of different widths corresponding to the lugs 10 and 11 of mixer 1 of FIG. 1. The outer surface of the cap is provided with ribs 66 and a collar 70 for better gripping. The coded attachment of the closure cap to cartridge 12 or 24 is analogous to the attachment of mixer 1.

Figure 9A:
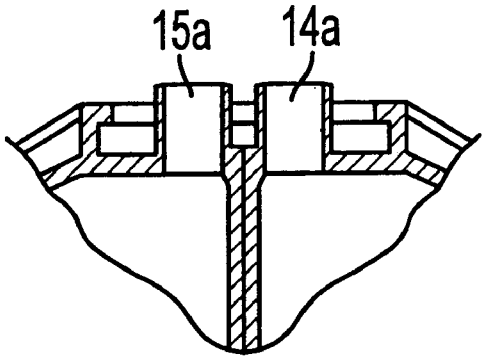
FIG. 9*a* is a detailed view of a cartridge with distanced outlets of different size.
Figure 9:
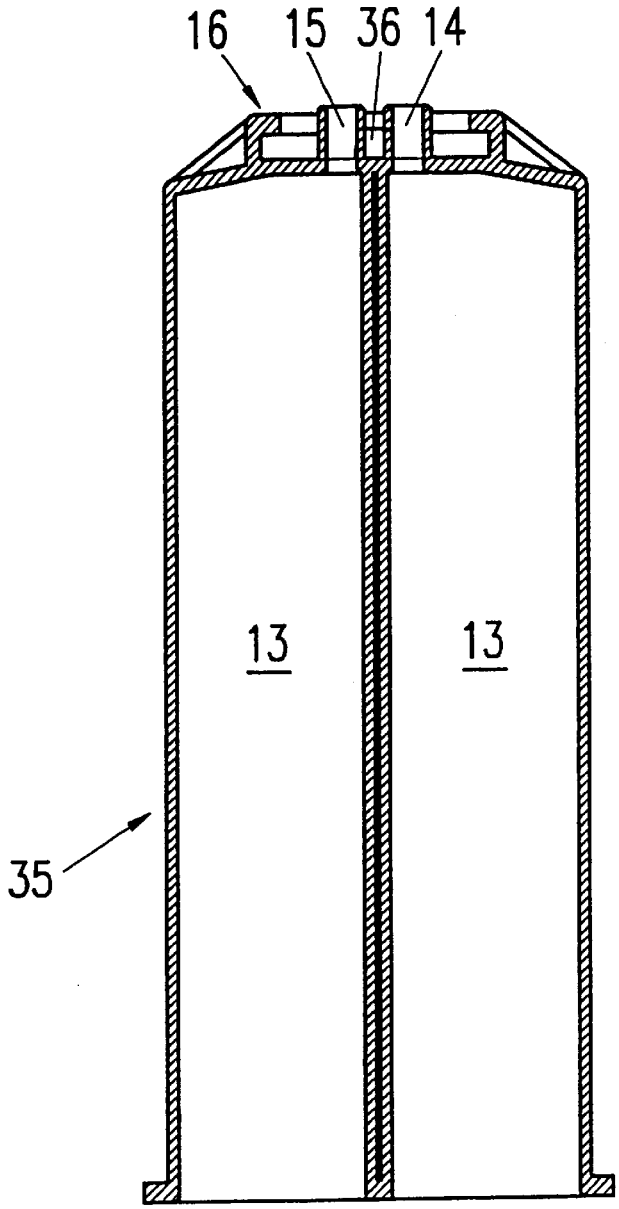
Figure 10:
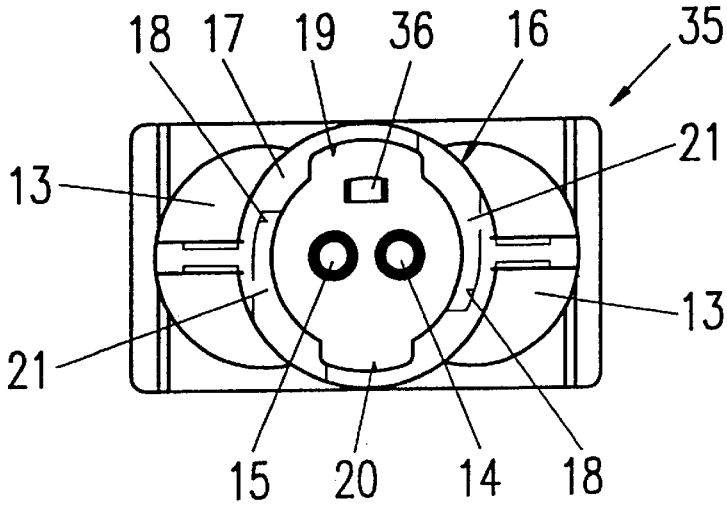
Figure 22:
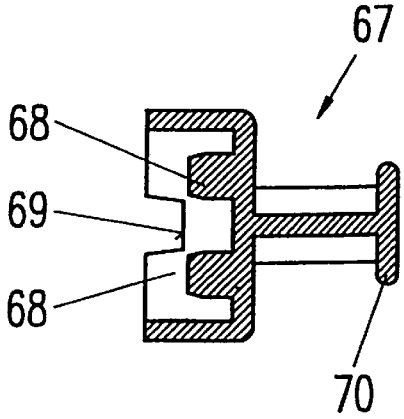
Figure 23:
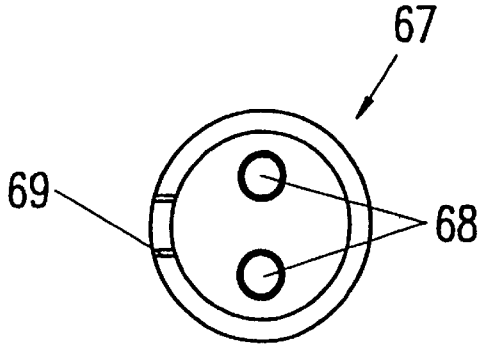

The second embodiment, FIGS. 22 and 23, consists of a coded closure cap 67, which also has two plugs 68 for closing the outlets of a cartridge, for example the distanced male outlets 14 and 15 of cartridge 35 of FIG. 9, and a slot 69 similar to slot 30 at mixer 25 for coded cooperation with nose piece 36 of cartridge 35. The outer surface of the cap is also provided with a collar 70 for better manual gripping. The attachment of the cap to cartridge 35 is achieved with coupling ring 31 of FIG. 11, analogous to the attachment of mixer 25 to that cartridge.

Figure 24:
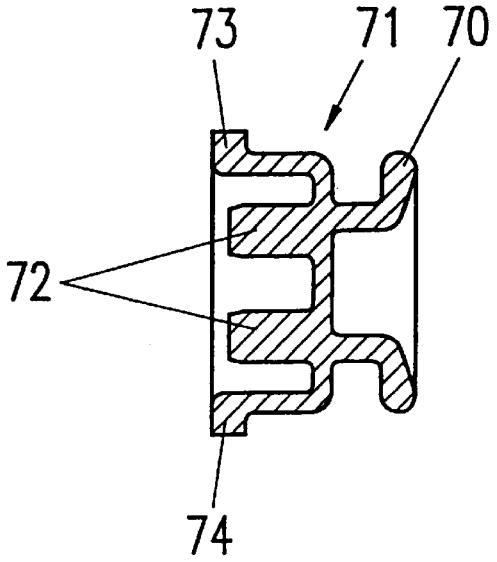
Figure 25:
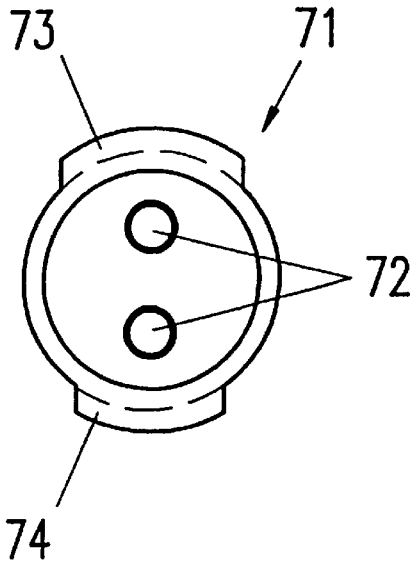

The third embodiment of a coded closure cap 71, FIGS. 24 and 25, is similar to the second embodiment and comprises two plugs 72 for closing the distanced male outlets 45 and 46 of cartridge 42 of FIG. 14. FIG. 25 shows the cartridge side of the closure cap with two bayonet lugs 73, 74 of different width and diametrically opposed on the edge facing the cartridge. This closure cap is attached by means of the locking ring 51 of FIGS. 18 and 19 and is also provided with a collar 70 for better manual gripping.

The ring-shaped bayonet attachment means of the cartridge ensures a better stability of its outlet area and stronger retaining of the bayonet lugs compared with prior art bayonet attachment means.

In the case of utilizing the advantages of the ring-shaped bayonet socket alone and without the need for coded attachment, the bayonet lugs 10 and 11, 32 and 33, 64 and 65 at the mixer or closure cap or accessory as well as the corresponding bayonet cutouts 19 and 20 at the retaining means at the cartridge or 56 and 57 at the locking ring 51, may have the same widths. This applies also in the case when more than two lugs and corresponding cutouts are used, for example three or four respectively.

Figure 26:
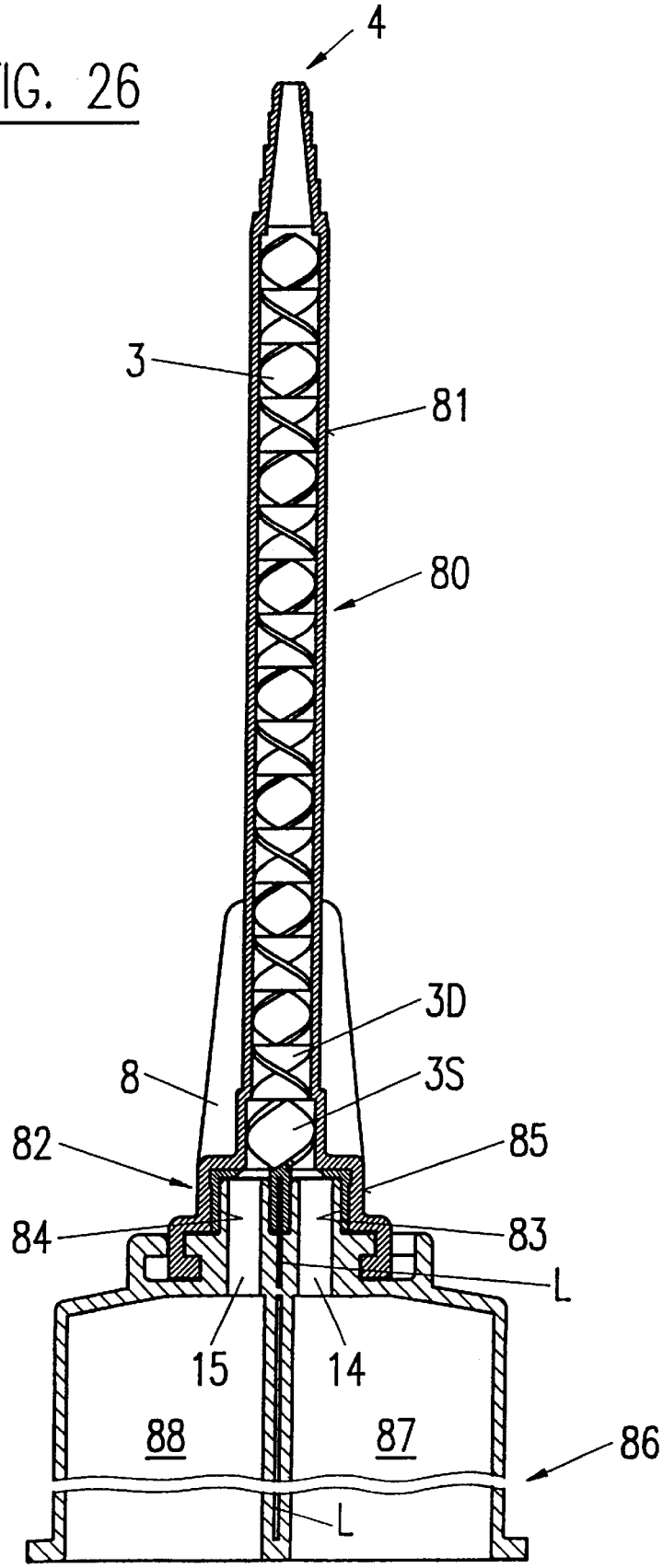
Figure 27:
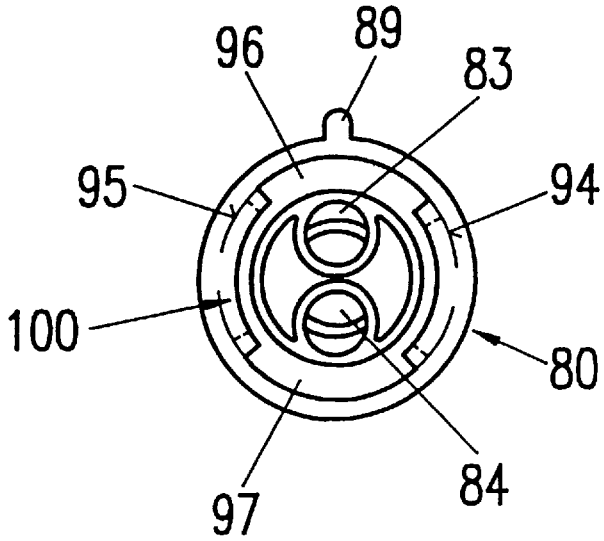
Figure 28:
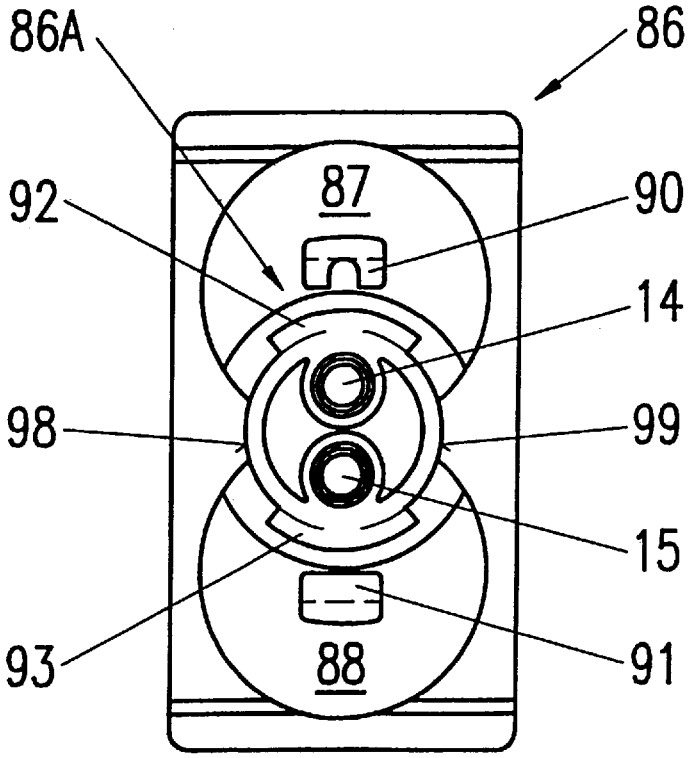

The FIGS. 26–28 show a further embodiment of the invention with an inverse bayonet arrangement as compared with those of the bayonet arrangement of the mixer and cartridge according to FIGS. 1–4. FIG. 26 shows a mixer 80 comprising a mixer housing 81 with mixer outlet 4 and a mixer inlet section 82 containing two separated inlet parts 83 and 84 followed by a separating element 3S, which in turn is fixedly attached to a properly aligned element 3D of the mixer element group 3. Also this mixer is attached to the cartridge by matching the coding means of mixer and cartridge by pressing the mixer onto the cartridge and by rotating the mixer housing 81 of the mixer about the integral internal mixer parts comprising separate female inlets 83 and 84, the separating element 3S and the mixer element group 3. The mixer element group or part thereof could also be prealigned and be fixedly assembled within the mixer housing.

The mixer housing 81 is provided with longitudinal ribs 8, which end at the larger diameter 85. The larger end of the mixer housing has a nose piece 89, which provides a highly visible coded guide for alignment and insertion into the slotted prong 90 of the cartridge. The mixer housing 81 is also provided with a ring shaped bayonet socket attachment means 100 comprising two bayonet flange parts 94 and 95 acting as bayonet retaining means, having two cut outs 96 and 97 in between.

The cartridge 86 has two cylindrical containers 87 and 88 with the distanced outlets 14 and 15 for fitting and sealing within the mixer inlet section 82. The cartridge front 86A is provided with a slotted prong 90 and a guide piece 91 for preventing incorrect insertion of the mixer and further with two bayonet flanges 92 and 93 with tapered wedge shaped edges, corresponding in width with the mixer cutouts 96 and 97, and with reduced diameter cutouts 98 and 99 in between.

For attaching the mixer to the cartridge, the mixer inlet part 82 is introduced into the cartridge by aligning the nose piece 89 of the mixer housing within the slotted prong 90 while the part 91 acts as a guide piece as the mixer inlets are pushed onto and over the cartridge distanced male outlets 14 and 15 such that the cartridge flanges 92 and 93 correspond to and enter within the mixer cutouts 96 and 97. Upon rotating the mixer housing, the mixer bayonet flange parts 94 and 95 progressively move against the cartridge flanges 92 and 93, because of their tapered wedge shaped depth, forcing the mixer 80 against the cartridge front 86A. During this mixer to cartridge attachment, the mixer housing 81 rotates 90° about the stationary integral internal mixer parts.

The above bayonet arrangement, wherein the ring-shaped bayonet socket is at the accessory, as shown for a rotating mixer housing, can also be used in analogous manner for previously shown embodiments and for the closure caps, with the exception of the locking ring solutions. Alternative coding means arranged around the outer periphery of the mixer housing are possible or is achieved by different widths of cutouts and matching flange parts.

Figure 29:
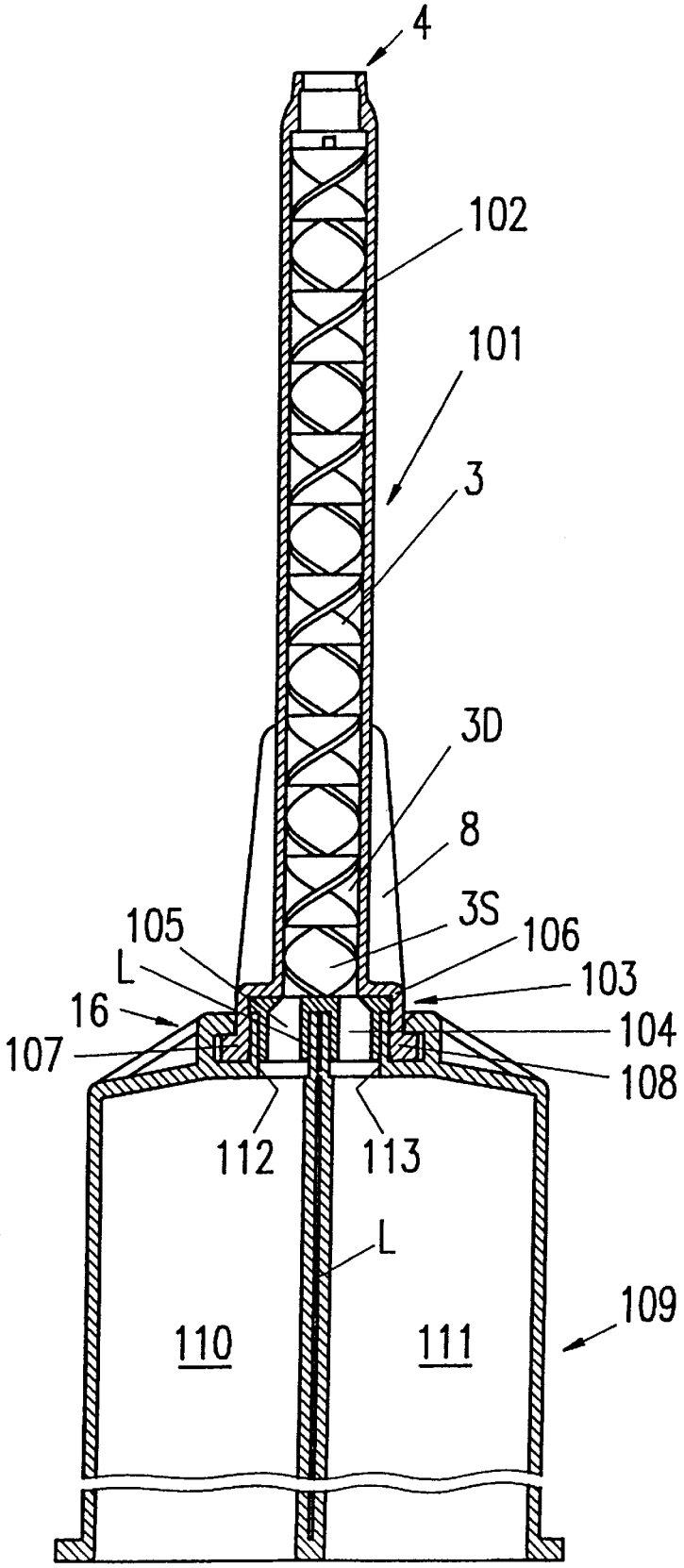
Figure 30:
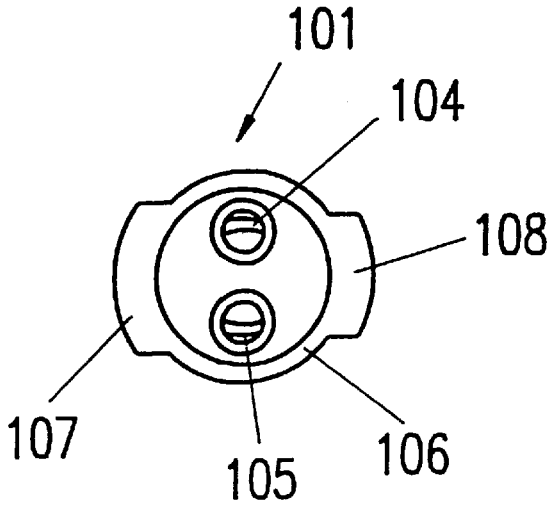
Figure 31:
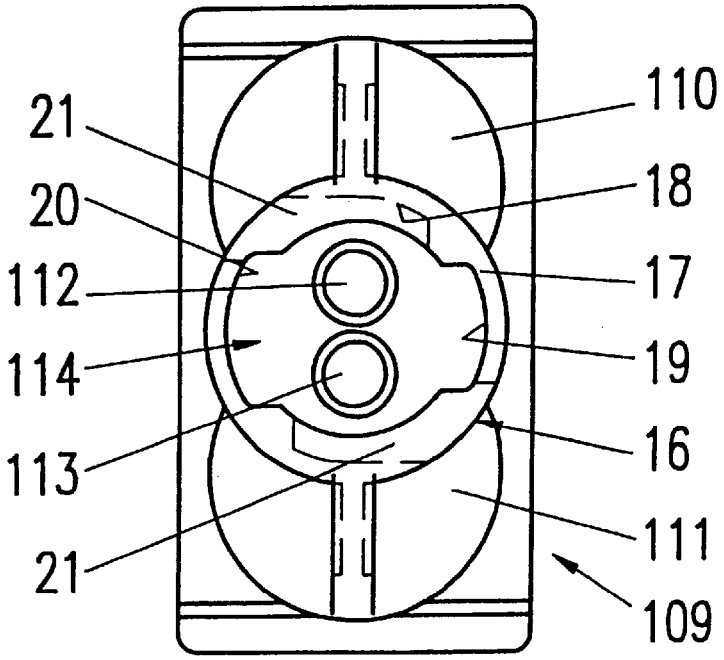

FIGS. 29–31 show a further embodiment wherein the mixer is provided with male inlet parts fitting into and sealing within the female cartridge outlets.

FIG. 29 shows a mixer 101 comprising a mixer housing 102 with mixer outlet 4 and a mixer inlet section 103 containing two separate male inlets 104 and 105 followed by a separating element 3S which in turn is fixedly attached to a properly aligned first dividing element 3D of the mixer element group 3. Also this mixer is attached to the cartridge by matching the coding means of the mixer to the coding means of the cartridge, by pressing the mixer onto the cartridge and by rotating the mixer housing 102 about the integral internal mixer parts comprising separate male inlets 104 and 105, the separating element 3S and the mixer element group 3. The mixer element group or part thereof could also be prealigned and be fixedly assembled within the mixer housing.

The mixer housing 102 is provided with longitudinal ribs 8, which end at the larger diameter 106, the two lateral ends of which are formed as bayonet lugs 107 and 108, FIG. 30, cooperating with the bayonet retaining means of the cartridge. The bayonet lugs do not have the same width, lug 107 being larger.

The cartridge 109, FIG. 31, has two cylindrical containers 110 and 111 with the distanced female outlets 112 and 113 for fitting and sealing over the male mixer inlets 104 and 105. The cartridge front 114 is provided with the same bayonet means 16 as the cartridge of FIG. 4, comprising a ring shaped bayonet socket.

Figure 32:
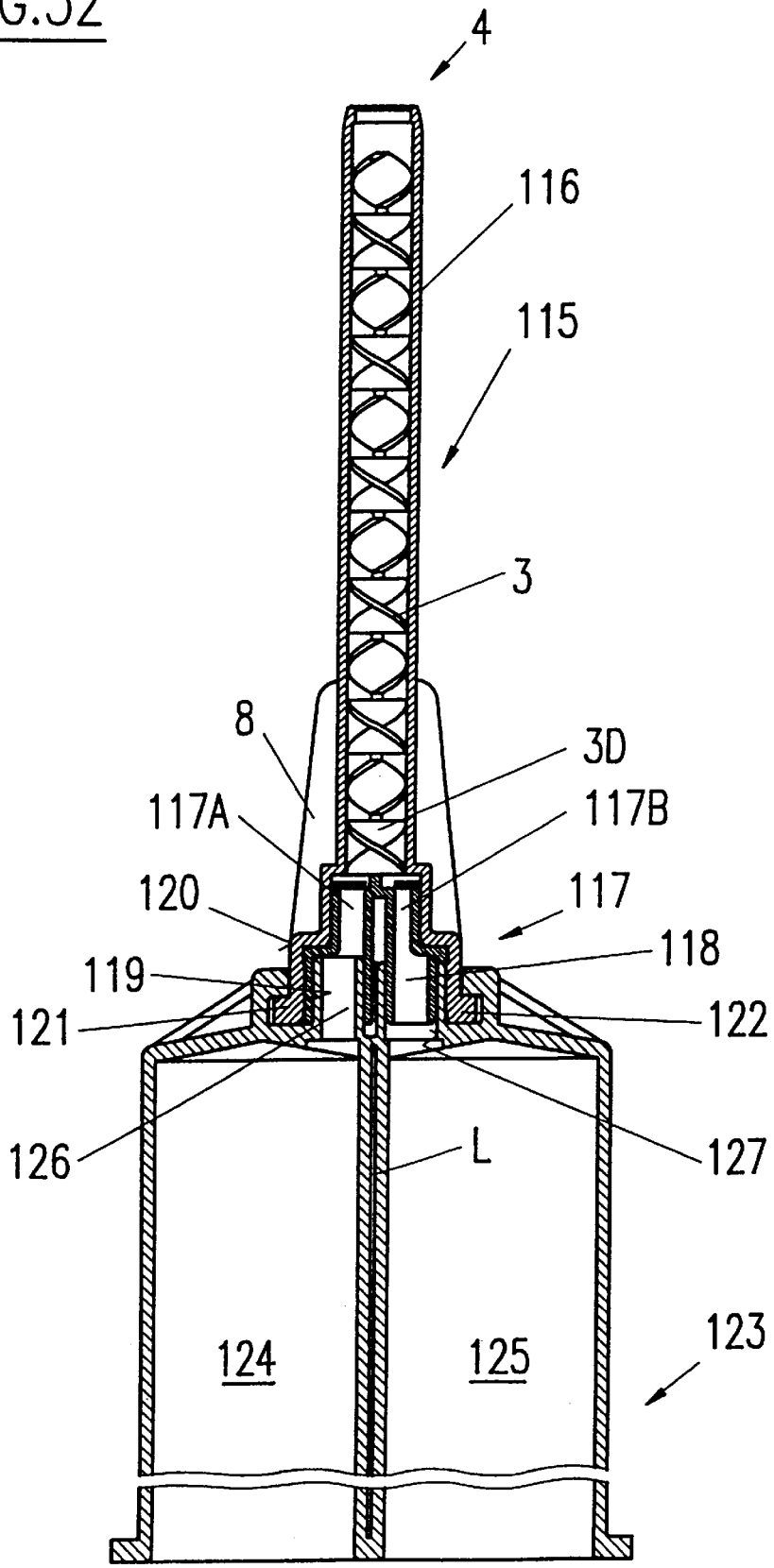
Figure 33:
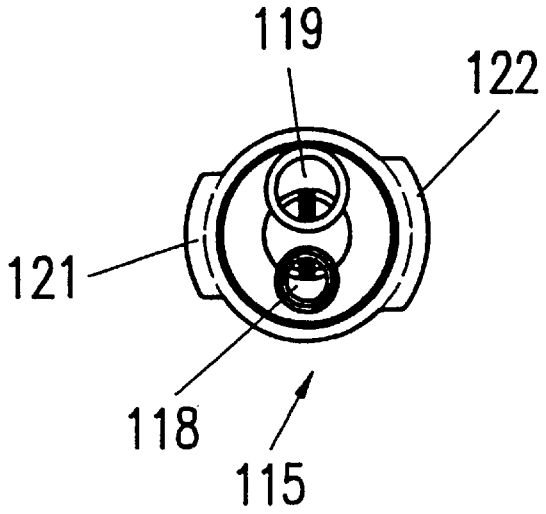
Figure 34:
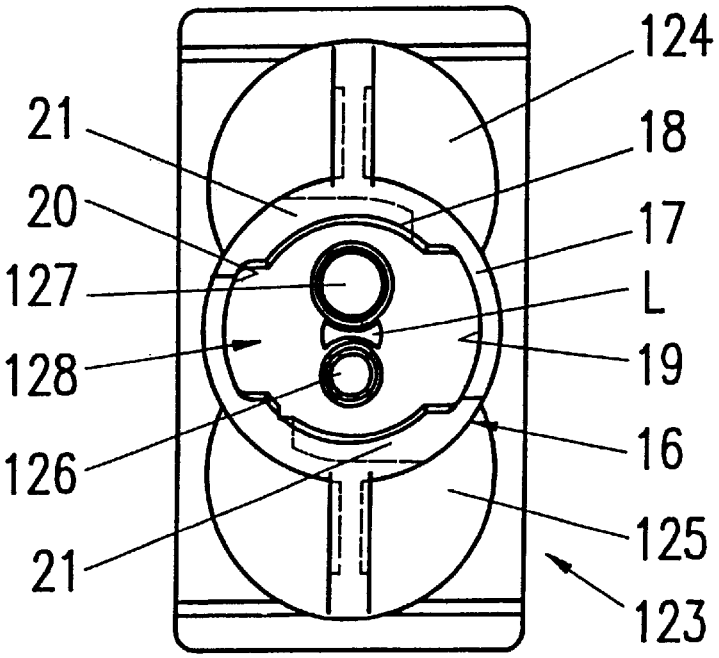

FIGS. 32–34 show a further embodiment wherein the mixer is provided with a male and a female inlet part fitting and sealing into/over the female/male cartridge outlets.

FIG. 32 shows a mixer 115 comprising a mixer housing 116 with outlet 4 and a mixer inlet section 117 containing a separate male inlet 118 and a separate female inlet 119 followed by separated chambers 117A and 117B, which in turn are fixedly attached to a properly aligned first dividing element 3D of the mixer element group 3. Also this mixer is attached to the cartridge by pressing the mixer onto the cartridge and by rotating the mixer housing 116 about the integral internal mixer parts comprising separate male inlets 118 and 119, the separated chambers 117A and 117B and the mixer element group 3. The mixer element group or part thereof could also be prealigned and be fixedly assembled within the mixer housing.

The mixer housing 116 is provided with longitudinal ribs 8, which end at the larger diameter 120, the two lateral ends of which are formed as bayonet lugs 121 and 122, FIG. 33, cooperating with the bayonet retaining means of the cartridge. The bayonet lugs do not have the same width, bayonet lug 121 being larger.

The cartridge 123 has two cylindrical containers 124 and 125 with one distanced male outlet 126 and one distanced female outlet 127 for, respectively, fitting and sealing within the separate female inlet 119 and over the separate male inlet 118 of the mixer. The cartridge front 128, FIG. 34, is provided with the same bayonet means 16 as the cartridge of FIG. 4, comprising a ring shaped bayonet socket.

The embodiments of FIGS. 35–43 show sector-shaped bayonet sockets instead of complete ring-shaped ones. The function and the attaching of the accessory are the same as in the previous embodiments, so that the three different embodiments of the bayonet means are illustrated in one respective example of mixer and cartridge. It is obvious that the sector-shaped bayonet socket and similar means can be provided on all other embodiments also.

Figure 35:
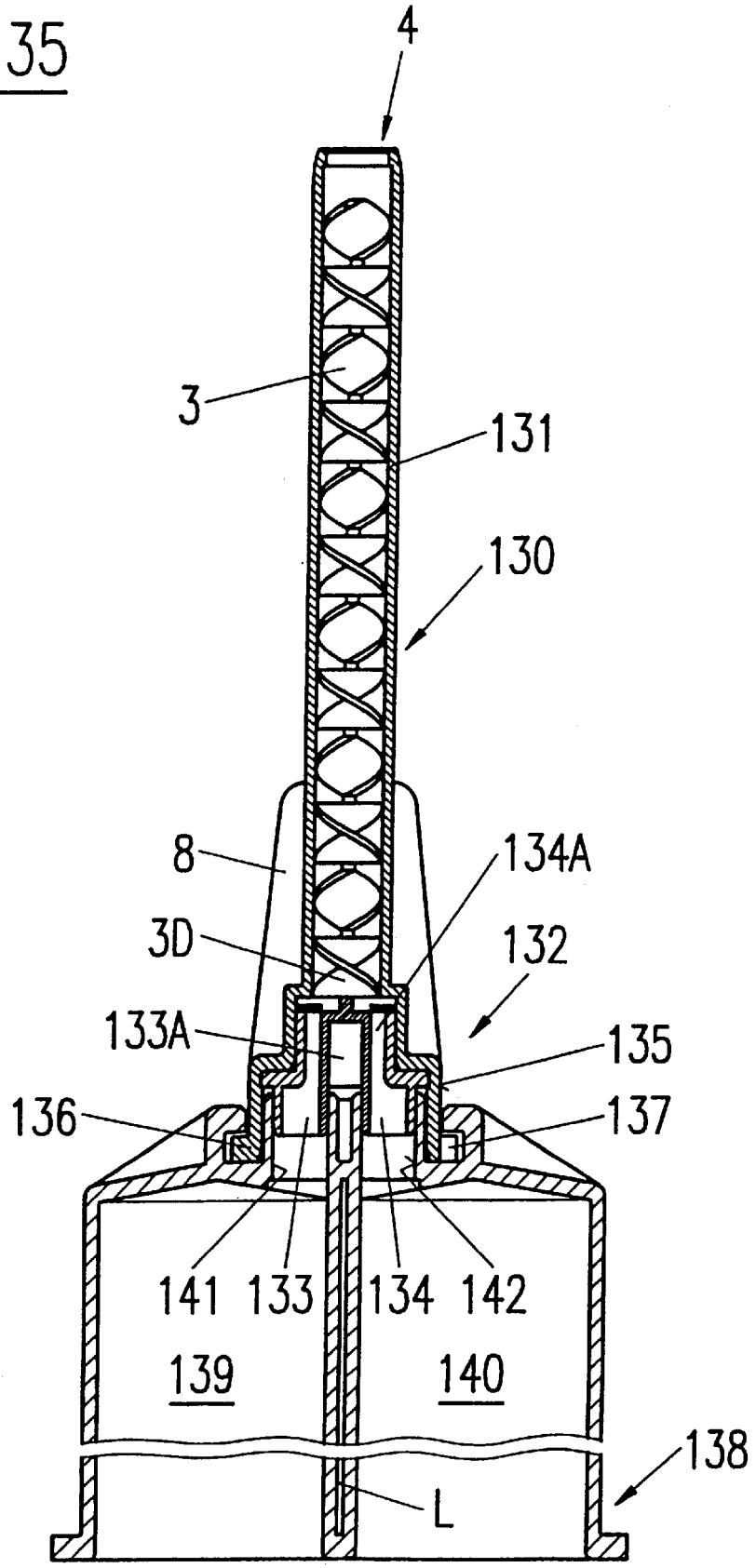

FIG. 35 shows a mixer-cartridge assembly with a mixer 130 comprising a mixer housing 131 with outlet 4 and a mixer inlet section 132 containing two separate male inlets 133 and 134 followed by separating chambers 133A and 134A which in turn are fixedly attached to a properly aligned first dividing element 3D of the mixer element group 3. Also this mixer is attached to the cartridge by pressing the mixer onto the cartridge and by rotating the mixer housing 131 about the integral internal mixer parts comprising separate male inlets 133 and 134, the separated chambers 133A and 134A and the mixer element group 3. The mixer element group or part thereof could also be prealigned and be fixedly assembled within the mixer housing.

Figure 37:
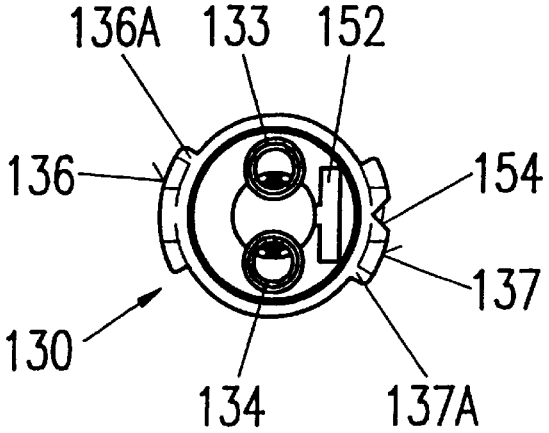

The mixer housing 131 is provided with longitudinal ribs 8, which end at the larger diameter 135, the two lateral ends of which are formed as bayonet lugs 136 and 137, FIG. 37, cooperating with the sector-shaped bayonet sockets 145, 146, serving as bayonet retaining means of the cartridge. The bayonet lugs have the same width and are provided each with a rib 136A and 137A at it's end which both strengthen each lug and acts as a stop as well as ensuring that the mixer can be turned and attached in one direction only. The upper surface of the lugs may have inclined surface parts so as to enforce the locking ability by an axial load. Corresponding inclined surface parts may also be located on the corresponding surface of the cartridge sector shaped bayonet sockets.

Figure 36:
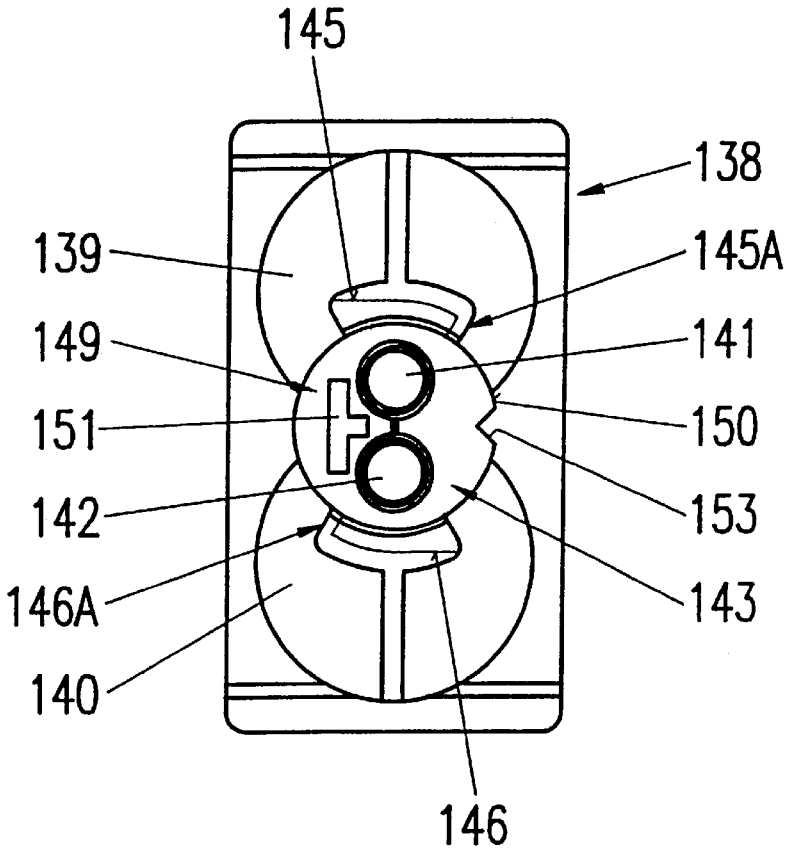

The cartridge 138 has two cylindrical containers 139 and 140 with two distanced female outlets 141 and 142 for receiving and sealing over the separate male inlets 133 and 134. The cartridge front 143, FIG. 36, is provided with bayonet means comprising sector-shaped bayonet sockets 145, 146 which act as prongs and are closed on one side by a rib 145A and 146A which connects to the cartridge end wall so as to stiffen and increase the strength of the bayonet prong. The cutouts 149 and 150 between the sector shaped bayonet sockets allow for the introduction of the mixer bayonet lugs 136 and 137.

In this embodiment the bayonet lugs and the sector shaped bayonet sockets have approximately the same width. The coding is achieved by other coding means on the mixer and on the cartridge. The cartridge front 143 is provided with a T-shaped protrusion 151 arranged between the two outlets and the mixer inlet face is provided with a similar protrusion 152 arranged off center between the mixer inlets, see FIGS. 36 and 37.

The two T-shaped coding means allow the attachment of the mixer in one orientation only since, when putting the mixer onto the cartridge such that when the two protrusions are laying one upon the other, they will prevent the introduction of the mixer inlets into the cartridge outlets and also any contact between the cartridge outlets and the mixer inlets or plugs of closure means thus preventing cross contamination and prohibiting mixer/accessory attachment. It is obvious that the coding protrusions can have any shape other than a T-form, and could be e.g., in the form of a keyway allowing only one defined position in which to introduce the mixer having a corresponding protrusion, or two differently shaped keyways and corresponding protrusions.

The coded alignment can be facilitated by visual coding means, e.g., a marking 153 at the cartridge outlet end and a marking 154 at the bayonet lug 137 of the mixer on the same side as the coding protrusion.

Figure 38:
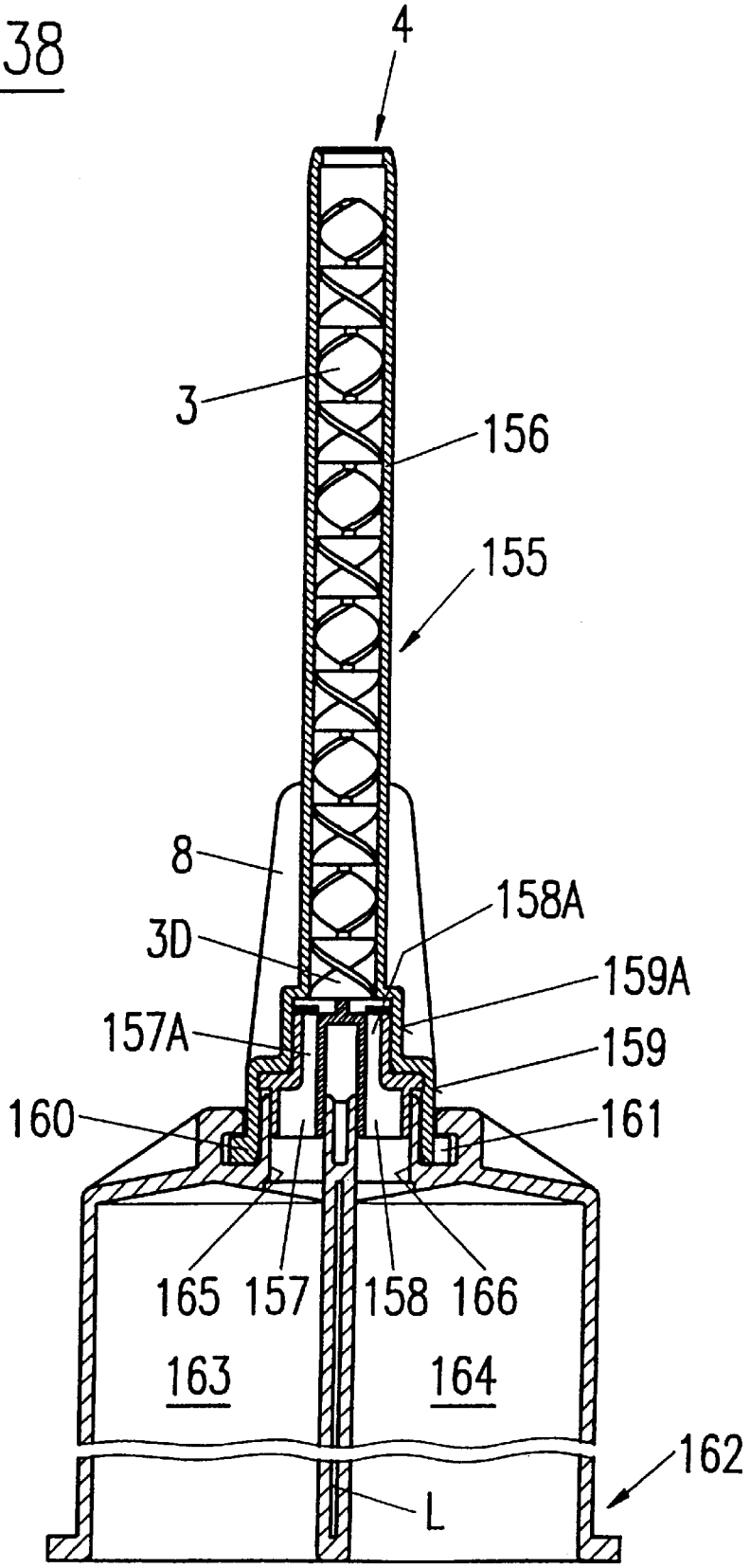
Figure 39:
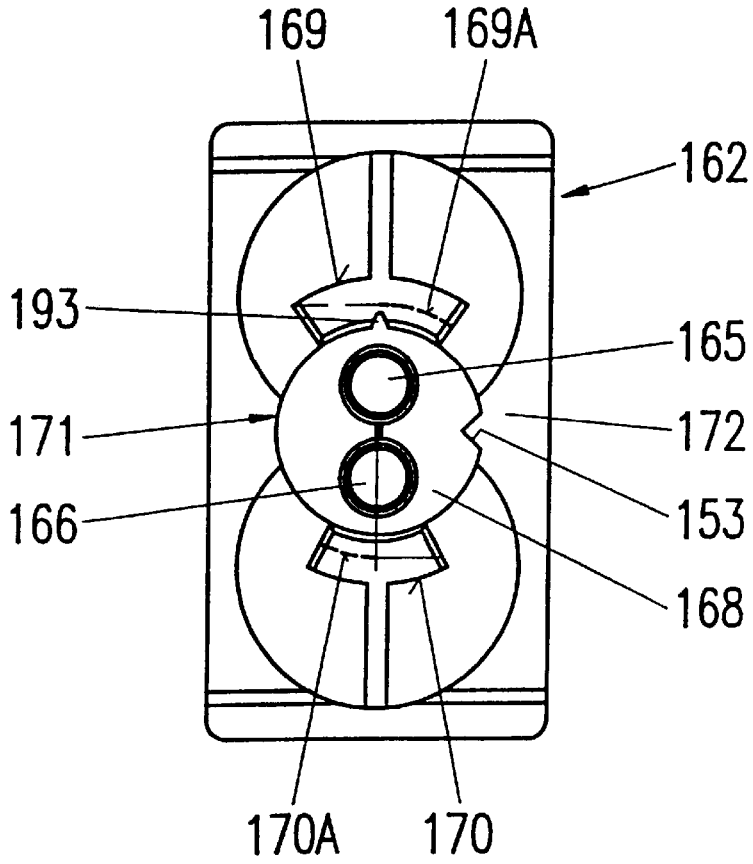
Figure 40:
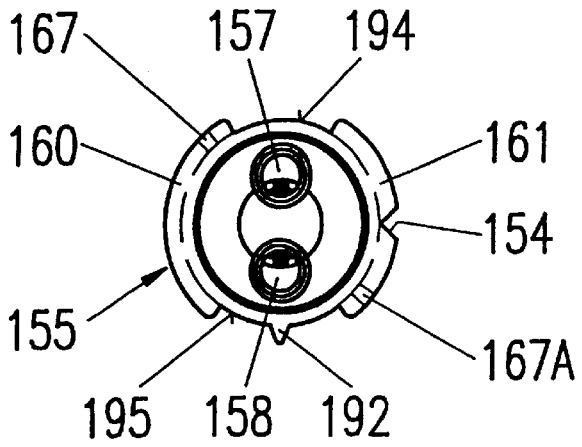

In the embodiment of FIGS. 38–40, the coding is achieved by cutouts of different widths between the lugs. FIG. 38 shows a mixer-cartridge assembly with a mixer 155 with a mixer housing 156, outlet 4 and integral internal mixer parts comprising two separate inlets 157 and 158 ending into a disc-shaped flange and followed by separated chambers 157A and 158A which in turn are fixedly attached to a properly aligned first dividing element 3D of the mixer element group 3. Also this mixer is attached to the cartridge by pressing the mixer onto the cartridge and by rotating the mixer housing 156 about the integral internal mixer parts. The mixer element group 3 or part thereof, may also be prealigned and fixedly assembled within the mixer housing.

The mixer housing 156 is provided with longitudinal ribs 8, which end at the larger diameter 159, the two lateral ends of which are formed as bayonet lugs 160 and 161, FIG. 40, cooperating with the sector shaped bayonet retaining means of the cartridge. In this FIG. 38 and also in FIGS. 13, 32, 35 and 45 it is shown that the inlet end of the mixer housing has not only one cylindrical enlargement but two, e.g., one 159 at the inlet, lodging and sealing against the separate inlets 157, 158, followed by the second part 159A having an intermediate diameter and lodging and sealing against the separating means 157A, 158A. The bayonet lugs have the same widths but the gaps or cutouts 194, 195 between them are different, corresponding to the different widths of the sector shaped bayonet sockets on the cartridge.

These bayonet lugs 160, 161, can be provided each with a rib 167, FIG. 40, on the reverse side of the mixer inlet which both strengthen the lug and act as stop as well as limiting rotation in one direction only so as to prevent the mixer from being attached at 180° to the correct alignment. The upper surface of the lugs may have inclined parts, not shown, so as to enforce the locking and sealing ability by an axial force. Corresponding inclined parts, not shown, may also be located on the corresponding surface of the cartridge sector shaped bayonet sockets.

The cartridge 162 has two cylindrical containers 163 and 164 with two distanced female outlets 165 and 166 for receiving and sealing over the separate male inlets 157 and 158. The cartridge front 168, FIG. 39, is provided with bayonet means, comprising two sector-shaped bayonet sockets.

In FIG. 39, the bayonet means at the cartridge comprises two diametrically opposed sector-shaped bayonet sockets 169 and 170 acting as bayonet prongs for the bayonet lugs of the mixer, the two sockets having different widths, socket 169 having the greater width. The two cut outs 171 and 172 between the sockets allow for the introduction of the corresponding mixer bayonet lugs 160 and 161 into the sector shaped bayonet sockets 169, 170. As shown in this Figure, the passages of the bayonet sockets 169 and 170 commence as straight passages but become curved front the mid point onwards so as to achieve a greater strength against bayonet lug axial forces.

The passages can be wholly curved, without straight parts, and wholly or partly curved passages can also be provided on the ring-shaped bayonet attachment means.

In order to prevent any inadvertent contact whatsoever of the mixer or accessory inlet or inlets with the cartridge outlet or outlets by any form of tilting or tipping of one against the other during incorrect alignment the larger cut out 195 at the mixer is provided with a V-shape nose 192 corresponding to a V-shape incision 193 at the larger socket 169 such that the mixer is kept outside of the narrower bayonet socket 170 by the V-shape nose 192.

In this embodiment also the coded alignment can be facilitated by visual coding means, e.g., marking 153 at the cartridge and marking 154 at the corresponding lug.

In case no univocal attachment of a mixer to the cartridge 162 is necessary the cut outs between the lugs of the mixer must be large enough to fit over the larger retaining means of the cartridge, whereas the visual coding means rest the same as previously described.

FIGS. 41–44 show a similar arrangement to that of the FIGS. 38–40 except that the mixer 200 is separate from coupling ring 196, the latter being rotated about the stationary mixer during the final rotary locking attachment of the coupling ring bayonet lugs 160A, 161A, into the sector shaped bayonet sockets 169, 170 of the cartridge 162.

Figure 41:
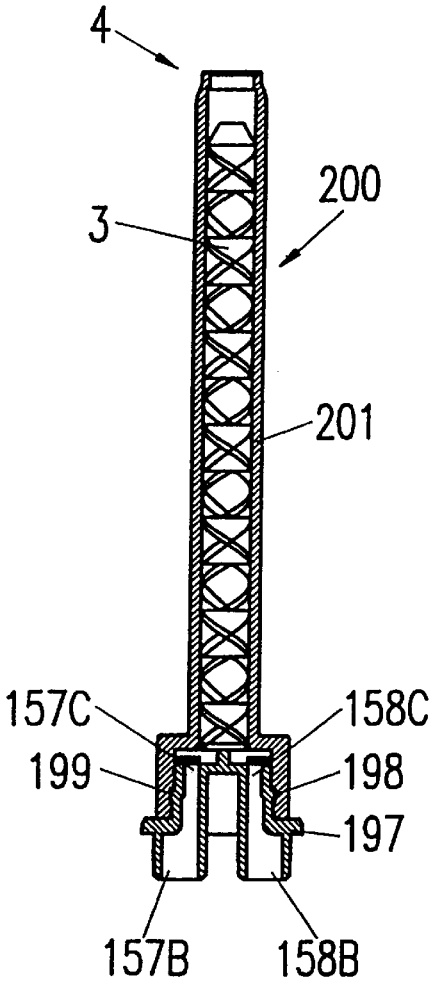
Figure 43:
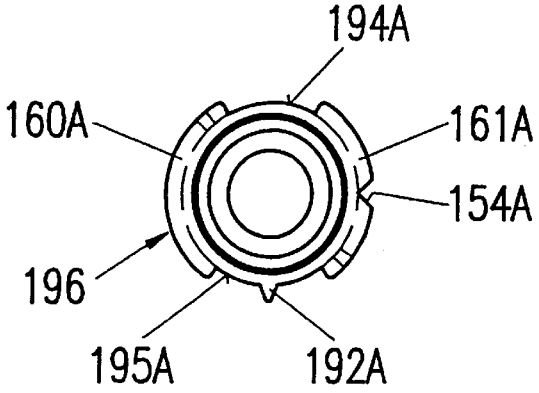

FIG. 41 shows mixer 200 with the outlet 4 and comprising a housing 201 containing the mixer element group 3 in alignment with inlet part 197, the latter only partially contained within the mixer housing and comprising separate male inlets 157B, 158B and separate chambers 157C, 158C. A ridge 198 lodges and seals the inlet part 197 within the mixer housing. The coupling ring 196 is preassembled and prealigned with the mixer inlet part 197 via a groove 199, FIG. 41, in the coupling ring 196. FIG. 43 shows coupling ring 196 with the same coded bayonet lugs 160A, 161A, cut outs 194A, 195A, visual coding 154 and V-shape nose coding 192A as used in the embodiment according to FIG. 40.

Figure 44:
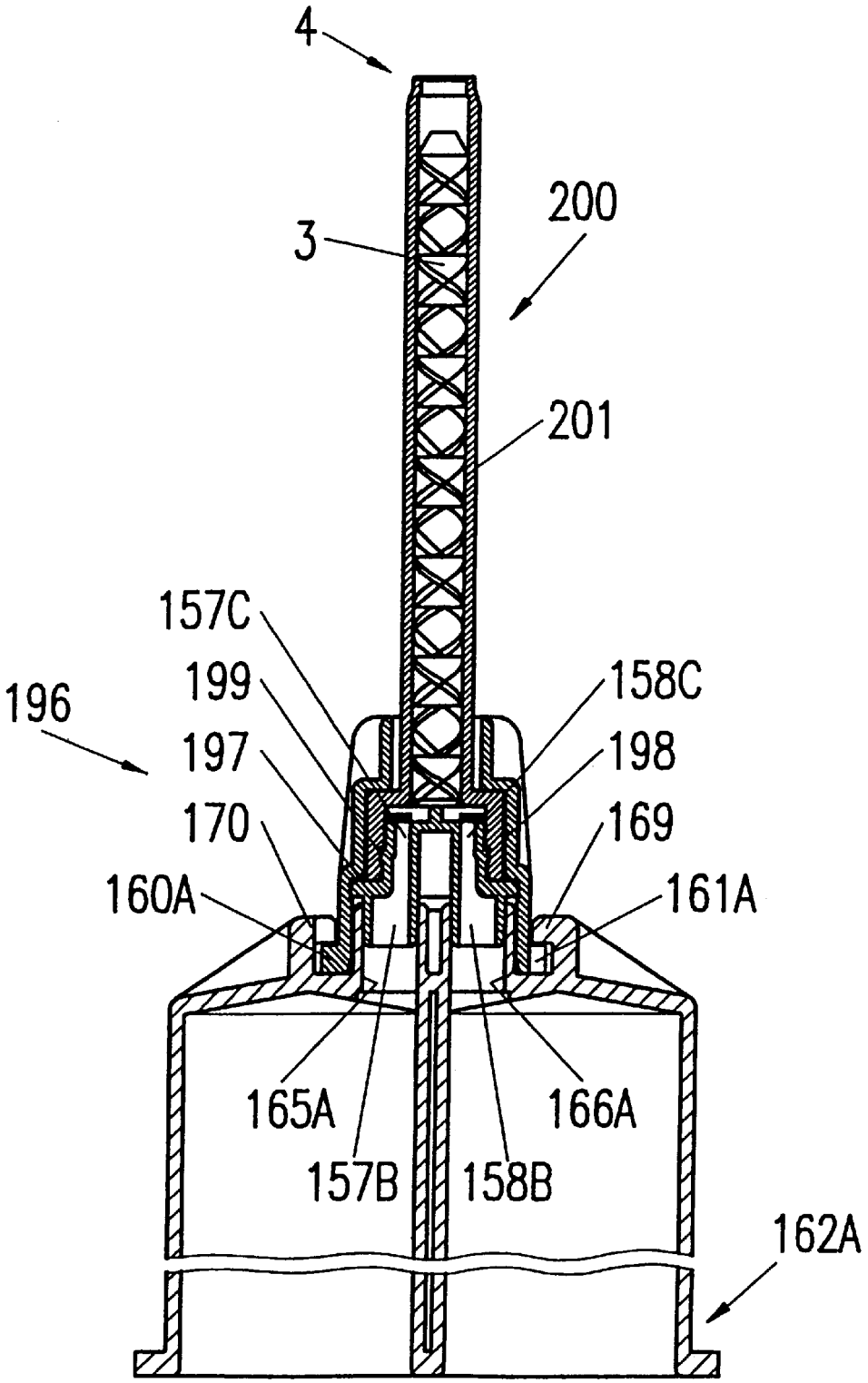

FIG. 44 shows the mixer 200 and the cartridge 162 when assembled together. Prior to such assembly, the coupling ring 196 may be pre-assembled to the mixer under sufficient tension such that both components are held together in the correct relative alignment for initial visual coded and initial axial mechanical coded contact and attachment of the mixer inlets 157B, 158B to the cartridge outlets 165, 166 on the cartridge prior to the final rotary locking attachment of the coupling ring as described above. In this embodiment therefore, there is no rotation of the mixer housing 201 about the mixer inlet part 197 and element group 3 during attachment.

Figure 45:
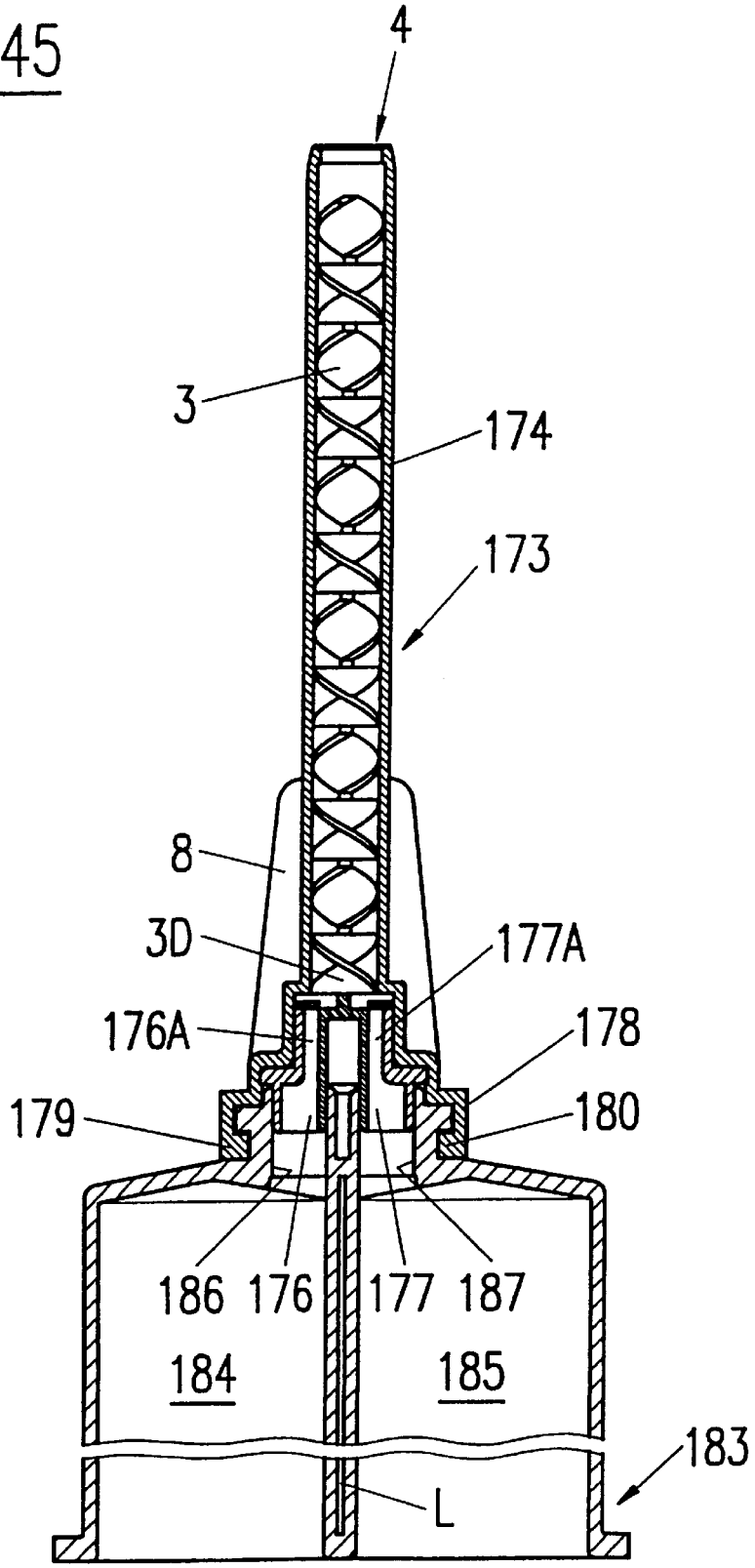
Figure 46:
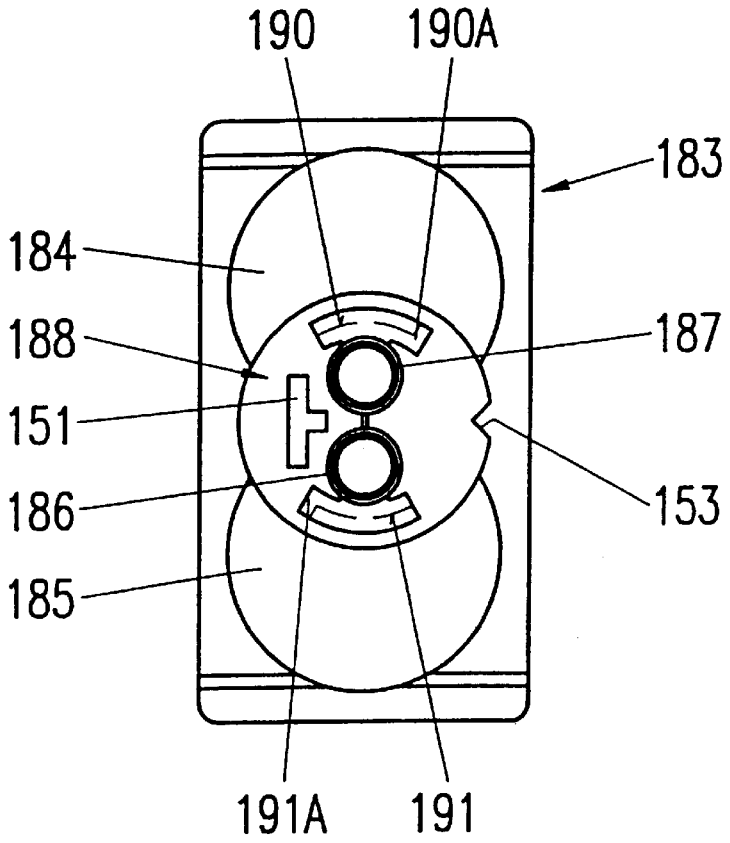
Figure 47:
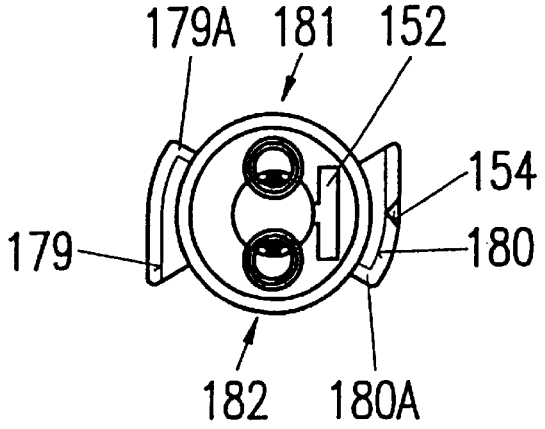

In the embodiment according to FIGS. 45–47 the sector-shaped bayonet sockets are at the mixer and the bayonet lugs at the cartridge, in analogy to the embodiment according to FIGS. 26–28.

FIG. 44 shows a mixer-cartridge assembly with a mixer 173 comprising a mixer housing 174 with outlet 4 and a mixer inlet section 175 containing the integral internal parts comprising two separate male inlets 176 and 177 followed by separated chambers 176A and 177A which in turn are fixedly attached to a properly aligned first dividing element 3D of the mixer element group 3. Also this mixer is attached to the cartridge by pressing the mixer onto the cartridge and by rotating the mixer housing 174 about the separate male inlets 176 and 177, the separated chambers 176A and 177A and the mixer element group 3. The mixer element group or part thereof could also be pre-aligned and be fixedly assembled within the mixer housing.

The mixer housing 174 is provided with longitudinal ribs 8, which end at the larger diameter 178, the two lateral ends of which are formed as two diametrically opposed sector-shaped bayonet sockets 179 and 180 (see FIG. 43) acting as prongs which are both closed at one side by a rib 179A and 180A connecting to the mixer wall so as to stiffen and increase the strength of the bayonet prong. The cut-outs 181 and 182, between the sockets, allow for the introduction of the cartridge bayonet lugs cooperating with the bayonet retaining means of the mixer.

Figure 42:
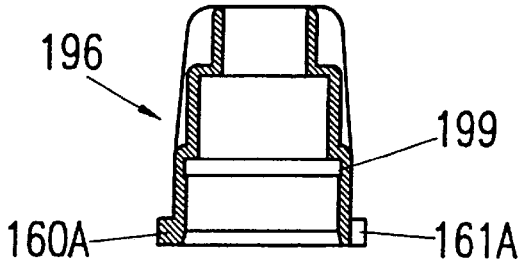

The cartridge 183 has two cylindrical containers 184 and 185 with two distanced female outlets 186 and 187 for fitting and sealing over the separate male inlets 176 and 177. The cartridge front 188, FIG. 42, is provided with bayonet means, comprising sector-shaped bayonet lugs 190 and 191 having the same width and each being provided with a rib 190A and 191A at it's end which strengthens the lug and act as a stop as well as limiting rotation in one direction only so as to prevent the mixer from being attached at 180° to the correct alignment. The upper surface of the lugs may have inclined surface parts, not shown, so as to enforce the locking ability by an axial load. Corresponding inclined surface parts, not shown, may also be located on the corresponding surface of the mixer sector shaped bayonet sockets.

The lugs and the cutouts have approximately the same width. Thus, the required coding is achieved by other coding means on the mixer and on the cartridge. Therefore the cartridge front 188 is provided with the T-shaped protrusion 151 arranged between the two distanced female outlets and the mixer inlet race is provided with a similar shaped protrusion 152 arranged off center between the mixer inlets. See FIGS. 46 and 47.

The two T-shaped coding means allow the introduction of the mixer in one position only, since the placing of the mixer onto the cartridge is such that, when the two protrusions are laying one upon the other, they will prevent the introduction of the mixer separate male inlets into the cartridge distanced female outlets as well as any contact between the cartridge outlets and the mixer inlets, thus prohibiting cross contamination and mixer/accessory attachment. It is obvious that the coding protrusions can have any shape other than a T-form.

There are situations where the T-shaped coding protrusion give not a 100% protection to warrant no cross-contamination. FIGS. 48–58 show several coding protrusions, which are believed to warrant that no cross-contamination can occur even if the mixer is introduced onto the cartridge in the wrong sense. To this end the coding protrusions are arranged thus that no tilting around the axis connecting the centers of the two outlets of the cartridge, which could cause this contamination.

Figure 48:
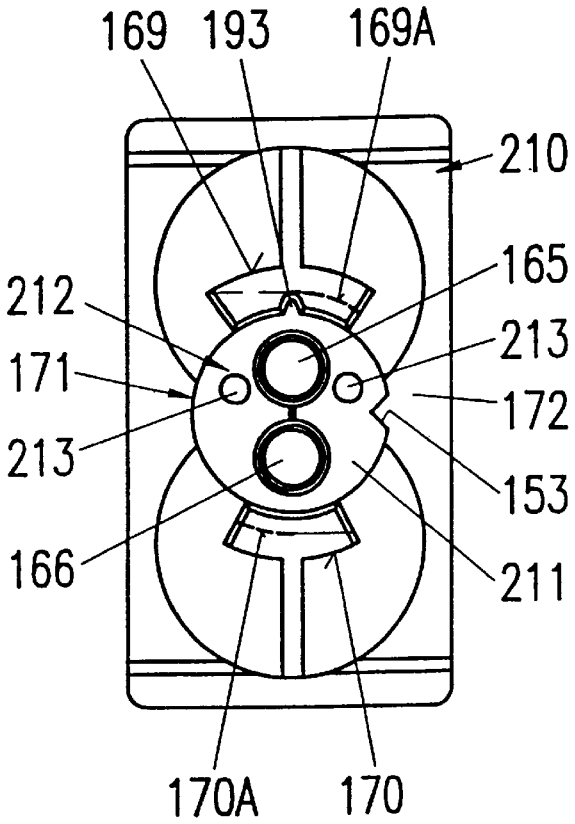

The cartridge 210 of FIG. 48 is similar to the cartridge 162 of FIG. 39 and has the same two cylindrical containers with two distanced female outlets 165 and 166 for receiving and sealing over the separate male inlets 157 and 158. The cartridge front diametrically opposed sector-shaped bayonet sockets 169 and 170 acting as bayonet prongs for the bayonet lugs of the mixer, the two sockets having different widths, socket 169 having the greater width. The two cutouts 171 and 172 between the sockets allow for the introduction of the corresponding mixer bayonet lugs 160 and 161 into the sector shaped bayonet sockets 169, 170. As shown in this Figure, the passages of the bayonet sockets 169 and 170 commence as straight passages but become curved from the mid point onwards so as to achieve a greater strength against bayonet lug axial forces.

In addition to the cartridge of FIG. 39, the front of this cartridge 210 is provided with a coding protrusions 212, consisting of two pins 213 arranged symmetrically to the axis connecting the centers of the outlets but asymmetrically as regards the transversal middle axis, e.g., on the side of one outlet.

Figure 49:
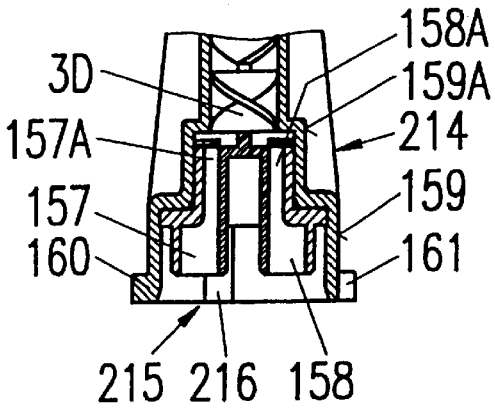

FIG. 49 shows a mixer 214 similar to the mixer 155 of FIG. 38 with a mixer housing 156, outlet 4 and integral internal mixer parts comprising two separate inlets 157 and 158 followed by separated chambers 157A and 158A, which in turn are fixedly attached to a properly aligned first dividing element 3D of the mixer element group 3. Also this mixer is attached to the cartridge by pressing the mixer onto the cartridge and by rotating the mixer housing 156 about the integral internal mixer parts. The mixer element group 3 or part thereof, may also be prealigned and fixedly assembled within the mixer housing.

The mixer housing 156 is provided with longitudinal ribs 8, which end at the larger diameter 159, the two lateral ends of which are formed as bayonet lugs 160 and 161 cooperating with the sector shaped bayonet retaining means of the cartridge. This mixer can also have two enlargement, e.g., one 159 at the inlet, lodging and sealing against the separate inlets 157, 158, followed by the second part 159A having an intermediate diameter and lodging and sealing against the separating means 157A, 158A. The bayonet lugs have the same widths but the gaps or cut outs 194, 195 between them are different, corresponding to the different widths of the sector shaped bayonet sockets on the cartridge, and have also ribs.

In addition to the mixer of FIG. 38 the inlet part of this mixer 214 is provided with the same coding protrusions 215 as those of the cartridge, consisting of two pins 216 and arranged in accordance to the pins 213 of the cartridge such that the mixer can only be introduced the correct way with regard to the other coding means without the possibility of tilting if introduced by force the wrong way.

Figure 50:
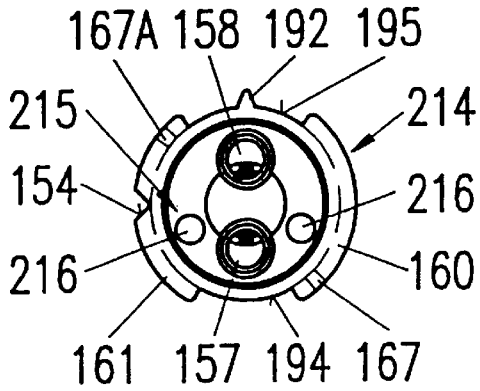

The FIGS. 51–58 show further arrangement and forms of coding protrusions 212, 215, whereby the cartridge as well as the mixer are always the same as in FIGS. 48–50 and only the coding protrusions are provided with numerals, the other parts being the same.

Figure 51:
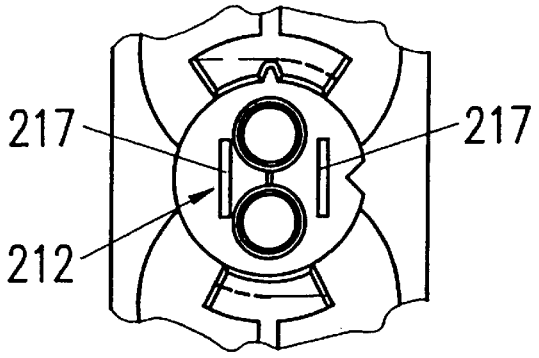
Figure 52:
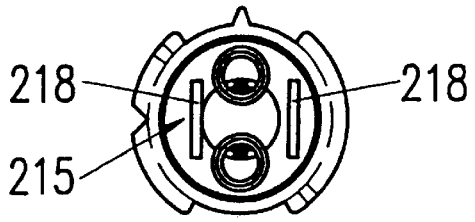

FIGS. 51 and 52 show a coding protrusions 212 on the cartridge front consisting of two bars 217 arranged symmetrically to the transversal middle axis of the cartridge but asymmetrically to the axis connecting the centers of the outlets. The two bars 218 of the mixer inlet part are arranged in accordance to those of the cartridge such that introduction and attachment of the mixer onto the cartridge is only possible in one position.

Figure 53:
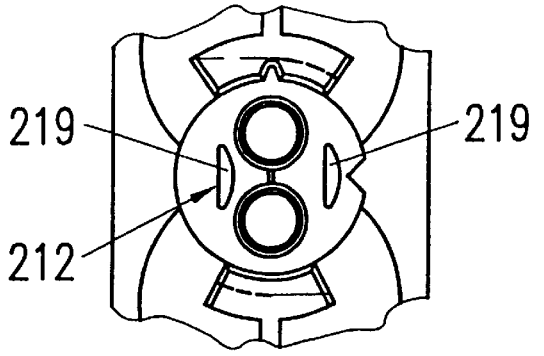
Figure 54:
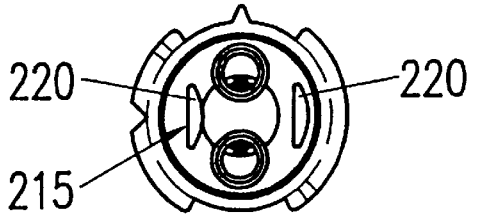

FIGS. 53 and 54 show a coding protrusions 212 on the cartridge front consisting of two D-shaped protrusion 219 arranged symmetrically to the transversal middle axis of the cartridge but asymmetrically to the axis connecting the centers of the outlets, with both flat sides looking in one direction. The two D-shaped protrusions 220 of the mixer inlet part are arranged in accordance to those of the cartridge such that introduction and attachment of the mixer onto the cartridge is only possible in one position.

Figure 55:
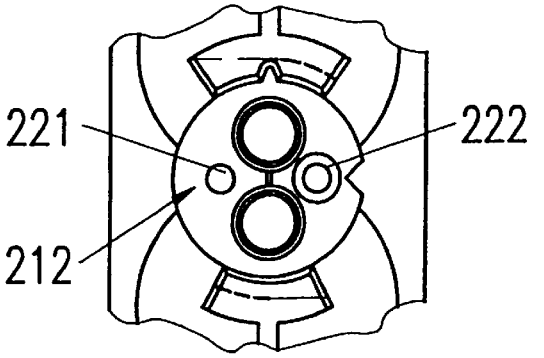
Figure 56:
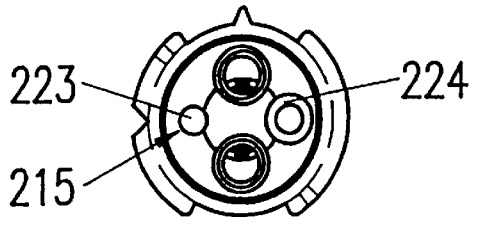

FIGS. 55 and 56 show a coding protrusions 212 on the cartridge front consisting of a male plug 221 and a female plug 222 arranged symmetrically. The male plug 223 and the female plug 224 of the mixer inlet part are arranged in accordance to those of the cartridge such that introduction and attachment of the mixer onto the cartridge is only possible in one position.

Figure 57:
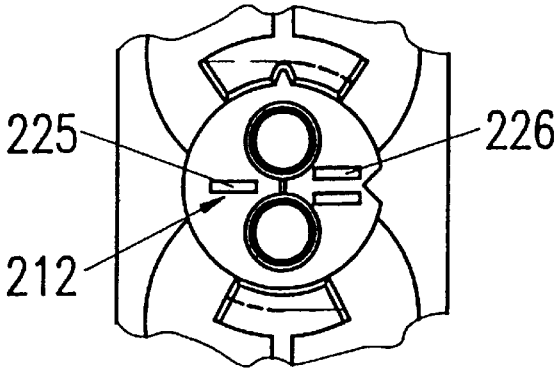
Figure 58:
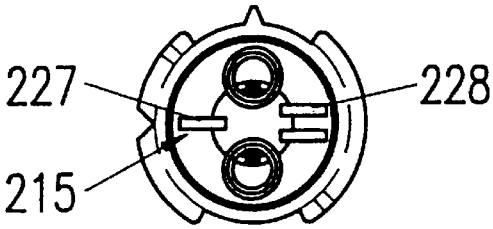
Figure 8A:
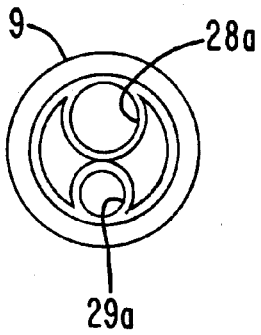
Figure 9A:
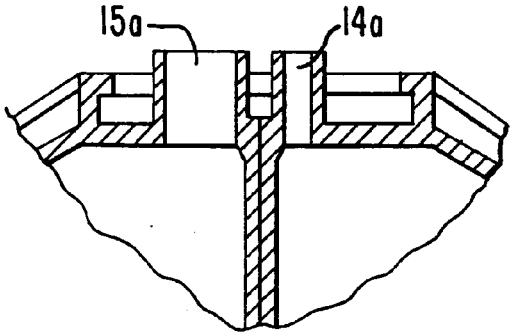

FIGS. 57 and 58 show a particularly effective coding protrusions 212 on the cartridge front consisting of a bar 225 on one side of the axis connecting the centers of the outlets and two spaced bars 226 on the other side of this axis, arranged symmetrically to the transversal middle axis of the cartridge. The single bar 227 and the double bar 228 of the mixer inlet part are arranged in accordance to those of the cartridge such that introduction and attachment of the mixer onto the cartridge is only possible in one position.

All these coding protrusions prevent efficiently tilting of the mixer during attachment to the cartridge and hence cross-contamination.

The coded alignment can be facilitated by visual coding means, e.g., the marking 153 at the cartridge, opposite the protrusion and the marking 154 at the lug of the mixer near the coding protrusion.

It follows from the embodiment according to FIGS. 32–34 that the mixer inlets and the cartridge outlets may be either female or male respectively and it follows also that it is possible to provide the mixer with one female and one male inlet fitting over/into the corresponding male/female outlet of the cartridge.

This latter arrangement provides for a further coding means since only one position is possible for matching the mixer or closure means to the cartridge. This mixed arrangement of coding and coding means is independent from the manner of attachment with a coupling ring, locking ring or rotatable mixer housing.

While the different widths of the bayonet lugs provide for a distinct coding means, it might be advantageous to enhance this effect by visualisation of the coding by optical means such as different colors, a notch and a marking or by providing one lug of the accessory with a cut-out and the corresponding nose at the cartridge bayonet means. This can be done either for visual marking one of the coding parts or for the coding itself.

Cartridges separated with one single wall, e.g., according to U.S. Pat. No. 5,333,760, cannot exclude chemical migration through such a single wall separation barrier and therefore separation at the cartridge outlets is not sufficient to prevent migration and therefore a reaction within the cylinders during storage.

It follows in particular from the FIGS. 5, 14, 26, 29, 32, 35, 38 and 41 that it is advantageous to provide for a single piece cartridge consisting of two complete, preferably cylindrical containers which are substantially separated by an air gap L in between, see e.g. FIG. 32. This assures a total chemical separation along the whole length where the chemicals are contained, ahead of the cylinder pistons, all the way to the top of the outlets where, during storage, a closure means is installed. During dispensing, this separation is further maintained within the mixer up to the first dividing element 3D of the mixer element group.

The invention however, is not limited to air gap separated containers and applies as well to cartridges with containers separated by one single wall according to FIG. 3.

It follows from the above description that the inventive cartridge to accessory attachment combination provides in particular for cartridge containers separated by an air gap up to and including the individual outlets and for a port to port coded alignment for same or dissimilar size ports, with no cross-contamination caused by rotation or random attachment, while maintaining separation past the interface and well into the mixer, so as to hinder the spreading of any possible reaction and plugging of the components at the interface and back into the cartridge outlets. This combination also provides optimization of the mixing performance especially, but not uniquely, for ratios other than 1:1.

While the foregoing description and the drawing of the cartridge embodiments pertained to multiple component cartridges with side-by-side containers the teaching of the present invention is not limited thereto and can be applied as well to cartridges with concentric containers or otherwise arranged and formed containers.

However, the principle of coded attachment ensures both the correctly aligned connection of a mixer or accessory to cartridge outlets since only one position of the mixer or accessory is possible and, in the case of the re-connection of mixer or closure cap to a cartridge, eliminates the possibility of cross-contamination.

Furthermore, and in respect to mixers, all the above described embodiments have the advantage of comprising the minimum number of parts and of being compact, resulting in low molding and assembly costs since the whole inlet section comprising the separating means and the mixer element group is made in one piece. Also the integral construction of this internal part ensures proper alignment thus providing optimum mixing efficiency.

In the case of the first embodiment according to FIG. 1 when a relatively long mixer element group is used and where rotational friction between this mixer element group and the mixer housing might cause problems, it may be preferable to separate a part or the whole of the mixer element group from the separating means of the inlet section such that a part or the whole of the mixer element group may be fixedly assembled within the housing and therefore it rotates with the housing while connecting the mixer to the cartridge.

In this case—and as seen from the mixer inlet to the mixer outlet—the leading edge of the first element of the mixer element group, or of a portion thereof, must be fixedly assembled within the housing in a pre-aligned position. Therefore, after rotating the housing so as to attach the mixer to the cartridge, correct alignment of the elements is achieved such that each of the two material streams leaving the separating means, or the first element group attached to the separating means, will be evenly divided by the leading edge of the first element of the element group, or portion thereof attached to the housing, for optimum mixing efficiency.

Figure 8A:
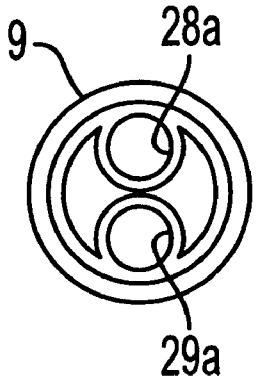
FIG. 8*a* is a view of an inlet end of the mixer according to an embodiment in which the inlets have different sizes.

It is evident that instead of cylindrical inlets and outlets, D-shaped or differently shaped similar or dissimilar sized inlets and outlets are possible (see FIGS. 8*a* and 9*a*). In certain embodiments, the respective inlets of the mixer housing or the outlets of the cartridge have different sizes or shapes providing the coded alignment between the cartridge and the mixer. Furthermore, the same principle can also be used for a dispensing device, or cartridge, for more than two components.

We claim:

1. A mixer for a cartridge, the cartridge having a plurality of chambers each having an outlet, the mixer comprising:

a housing;

a mixer element disposed in said housing;

a plurality of inlets for engagement with the outlets of the cartridge and mounted on said housing;

a bayonet coupling on said housing for detachably connecting said mixer to the multichamber cartridge, said bayonet coupling having locked and unlocked positions;

a coding element that permits said inlets of said housing to be aligned and connected to the outlets of the cartridge in only one orientation; and said coding element comprising each of said inlets being of different configuration from the other.

2. A mixer according to claim 1, wherein said coding element comprises said inlets being of different shape from each other.

3. A mixer according to claim 1, wherein said coding element comprises said inlets being of different size from each other.

4. A dispensing device, comprising:

a cartridge, a mixer, and complementary coding elements formed on said cartridge and mixer, said cartridge comprising:

a plurality of chambers each having an outlet, and a first bayonet coupling;

said mixer comprising:

a housing with a plurality of inlets corresponding in number to said outlets, each inlet being configured to engage a respective one of said outlets, a mixer element disposed in said housing, and a second bayonet coupling complementary with said first bayonet coupling of said cartridge, said first bayonet coupling being detachable from said second bayonet coupling and together forming a detachable bayonet assembly; and wherein said coding elements permit said inlets of said mixer to be aligned and connected to the respective outlets of said cartridge in only one orientation and wherein said coding elements comprise said outlets being of different size relative to each other and said respective inlets being configured to conform thereto.

5. A cartridge for a mixer, the mixer having a plurality of inlets, the cartridge comprising:

a plurality of chambers each having an outlet for engagement with the inlets of the mixer; and a bayonet coupling on said cartridge for detachably connecting said cartridge to the mixer;

each said outlet of said chambers being of a different configuration from each other said outlet to permit each said outlet to be aligned and connected to the respective inlets of the mixer in only one orientation.

6. A cartridge according to claim 5, wherein each said outlet of said chambers is of a different size from each other said outlet.

7. A cartridge according to claim 5, wherein each said outlet of said chambers is of a different shape from each other said outlet.

* * * * *

UNITED STATES PATENT AND TRADEMARK OFFICE

CERTIFICATE OF CORRECTION

PATENT NO. : 6,186,363 B1
DATED : February 13, 2001
INVENTOR(S) : Wilhelm A. Keller et al.

It is certified that error appears in the above-identified patent and that said Letters Patent is hereby corrected as shown below:

Drawings,
Fig. 8a and Fig. 9a are delete and replaced with the attached new Fig. 8a and Fig. 9a Signed and Sealed this Thirty-first Day of August, 2004

JON W. DUDAS
*Director of the United States Patent and Trademark Office*